US012410959B2

(12) United States Patent
Lim et al.

(10) Patent No.: US 12,410,959 B2
(45) Date of Patent: Sep. 9, 2025

(54) REFRIGERATOR

(71) Applicant: SAMSUNG ELECTRONICS CO., LTD., Suwon-si (KR)

(72) Inventors: Hyeonkyu Lim, Suwon-si (KR); Juyeong Kim, Suwon-si (KR); Hyunuk Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 133 days.

(21) Appl. No.: 18/124,369

(22) Filed: Mar. 21, 2023

(65) Prior Publication Data

US 2023/0221052 A1 Jul. 13, 2023

Related U.S. Application Data

(63) Continuation of application No. PCT/KR2021/013397, filed on Sep. 29, 2021.

(30) Foreign Application Priority Data

Oct. 29, 2020 (KR) ..... 10-2020-0142254

(51) Int. Cl.
*F25C 1/04* (2018.01)
*F25C 1/25* (2018.01)

(52) U.S. Cl.
CPC ..... *F25C 1/04* (2013.01); *F25C 1/25* (2018.01); *F25C 2400/10* (2013.01)

(58) Field of Classification Search
CPC ..... F25C 1/04; F25C 1/25; F25C 2400/10
See application file for complete search history.

(56) References Cited

U.S. PATENT DOCUMENTS 9,074,802 B2 7/2015 Culley et al.
9,074,803 B2 7/2015 Culley
(Continued)

FOREIGN PATENT DOCUMENTS

CN 102878743 A 1/2013
CN 206410387 U 8/2017
(Continued)

OTHER PUBLICATIONS

Supplementary European Search Report dated Jan. 2, 2024 for European Application No. 21886587.1.
(Continued)

*Primary Examiner* — Elizabeth J Martin
(74) *Attorney, Agent, or Firm* — STAAS & HALSEY LLP

(57) ABSTRACT

A refrigerator including a water supplier; an ice-making housing in a storage compartment; a first tray in the ice-making housing and including a first ice-making cell, and a first sealing portion formed along an edge of the first ice-making cell; and a second tray including a second ice-making cell, and a second sealing portion formed along an edge of the second ice-making cell, wherein the second tray is movable horizontally to engage with the first tray and couple the first and second ice-making cell, and while the second tray is engaged with the first tray, the second sealing portion overlaps the first sealing portion to prevent leakage from the first and second ice-making cells, the first ice-making cell forms a first portion of ice with water from the water supplier, and the second ice-making cell forms a second portion of the ice with water from the water supplier.

15 Claims, 31 Drawing Sheets

(56) References Cited

U.S. PATENT DOCUMENTS

| | | | | |
|---|---|---|---|---|
| 9,151,527 | B2 | 10/2015 | Boarman et al. | |
| 9,234,688 | B2 | 1/2016 | Son et al. | |
| 9,234,689 | B2 | 1/2016 | Son et al. | |
| 9,335,081 | B2 | 5/2016 | Son et al. | |
| 9,470,448 | B2 | 10/2016 | Culley et al. | |
| 9,581,372 | B2 | 2/2017 | Lee et al. | |
| 9,651,290 | B2 | 5/2017 | Boarman et al. | |
| 9,696,079 | B2 | 7/2017 | Boarman et al. | |
| 11,874,048 | B2 | 1/2024 | Kim et al. | |
| 2012/0007264 | A1 | 1/2012 | Kondou et al. | |
| 2013/0014536 | A1* | 1/2013 | Son | F25C 1/25 62/340 |
| 2013/0327074 | A1 | 12/2013 | Lee et al. | |
| 2014/0165598 | A1 | 6/2014 | Boarman et al. | |
| 2014/0165618 | A1* | 6/2014 | Culley | F25C 1/18 62/71 |
| 2014/0165619 | A1 | 6/2014 | Culley | |
| 2014/0165623 | A1 | 6/2014 | Guarino et al. | |
| 2016/0138844 | A1 | 5/2016 | Boarman et al. | |
| 2016/0252287 | A1 | 9/2016 | Dirnberger et al. | |
| 2019/0293335 | A1 | 9/2019 | Bertolini et al. | |
| 2020/0158403 | A1 | 5/2020 | Hong et al. | |
| 2020/0158410 | A1* | 5/2020 | Kim | F25C 1/24 |
| 2021/0310714 | A1* | 10/2021 | Olvera | F25C 1/24 |
| 2022/0260296 | A1* | 8/2022 | Ji | F25C 1/25 |
| 2023/0124642 | A1* | 4/2023 | Kim | F25C 1/243 62/71 |

FOREIGN PATENT DOCUMENTS

| | | | |
|---|---|---|---|
| CN | 209689245 | U | 11/2019 |
| CN | 111197886 | A | 5/2020 |
| EP | 0 326 144 | B1 | 12/1993 |
| EP | 2 549 207 | B1 | 4/2017 |
| EP | 3 261 449 | B1 | 4/2020 |
| JP | 6298123 | B2 | 3/2018 |
| KR | 10-2013-0009332 | | 1/2013 |
| KR | 10-2014-0088321 | | 7/2014 |
| KR | 10-1643635 | | 7/2016 |
| KR | 20-2017-0000751 | | 3/2017 |
| KR | 20-0482995 | | 3/2017 |
| KR | 10-1850918 | | 5/2018 |
| KR | 10-1890939 | B1 | 8/2018 |
| KR | 10-2019-0100119 | | 8/2019 |
| KR | 10-1968563 | | 8/2019 |

OTHER PUBLICATIONS

Extended European Search Report dated Mar. 25, 2024 for European Application No. 21886587.1.

International Search Report, PCT/ISA/210, dated Jan. 19, 2023, in International Application PCT/KR2021/013397.

Chinese Office Action dated May 24, 2025 for Chinese Application No. 202180067895.9.

* cited by examiner

REFRIGERATOR

CROSS-REFERENCE TO RELATED APPLICATIONS

This application is a continuation application under 35 U.S.C. § 111(a) of international Application No. PCT/KR2021/013397, filed on Sep. 29, 2021, which claims priority to Korean Patent Application No. 10-2020-0142254, filed on Oct. 29, 2020, the disclosures of which are incorporated by reference herein in their entireties.

BACKGROUND

1. Field

The present disclosure relates to a refrigerator, and more particularly, to a refrigerator including an improved ice making assembly.

2. Description of the Related Art

In general, a refrigerator is a device for cooling and storing food using a refrigeration cycle composed of a compressor, a condenser, an expansion valve, and an evaporator. An ice maker configured to make ice may be provided inside the refrigerator.

The ice maker includes an ice-making tray for making ice, an ejector for separating ice from the ice-making tray, an ice bucket for storing the ice separated from the ice-making tray, and a controller for controlling the entire ice-making process. Accordingly, the ice may be automatically produced and separated.

In this case, an ice maker that is not a pressing type may be provided with an open upper side so as to make ice having one flat surface. When the ice is made, adjacent ices are adhered to each other, and thus it is difficult to make ice in a certain size or shape.

Further, in the pressing type ice maker, a plurality of trays may form an ice making cell. The plurality of trays may be separated vertically and one tray may be rotationally coupled to another tray.

In this case, because the ice bucket is not provided in a rotation radius of the tray, an ice storage capacity may be reduced. In addition, remaining water may permeate into gaps between the plurality of trays, and thus the shape of the ice may not be neat and a large number of crumbs may be generated.

SUMMARY

Aspects of embodiments of the disclosure will be set forth in part in the description which follows and, in part, will be apparent from the description, or may be learned by practice of the presented embodiments.

According to an embodiment of the disclosure, a refrigerator may include a storage compartment; a water supplier to supply water received from an external water supply source; an ice-making housing in the storage compartment; a first tray disposed in the ice-making housing and including a first ice-making cell, and a first sealing portion formed along an edge of the first ice-making cell; and a second tray including a second ice-making cell, and a second sealing portion formed along an edge of the second ice-making cell. The first tray and the second tray may be configured so that the second tray is movable horizontally with respect to the first tray to engage with the first tray and couple the first ice-making cell to the second ice-making cell, and while the second tray is engaged with the first tray, the second sealing portion overlaps the first sealing portion to prevent leakage from the first ice-making cell and the second ice-making cell, the first ice-making cell forms a first portion of ice with water supplied from the water supplier, and the second ice-making cell forms a second portion of the ice with the water supplied from the water supplier.

According to an embodiment of the disclosure, the first sealing portion includes a recess recessed inward from an outer circumferential surface of the first tray, and the second sealing portion includes a protrusion extending outward from an inner circumferential surface of the second tray and configured to be mountable on the recess to maintain a seal between the first tray and the second tray.

According to an embodiment of the disclosure, the refrigerator further includes a cover frame coupled to the ice-making housing; a first case formed on one surface of the cover frame to receive the first tray; and a second case configured to be moved inside the cover frame, and to receive the second tray.

According to an embodiment of the disclosure, the refrigerator further includes a rack gear connected to the second case and configured to be moved relative to the cover frame, wherein the second case is moved horizontally with respect to the cover frame in conjunction with a movement of the rack gear.

According to an embodiment of the disclosure, the refrigerator further includes a driver configured to generate power; and a pinion configured to be rotated according to the drive of the driver; wherein the pinion and the rack gear are engaged to convert a rotational motion of the driver into a linear motion.

According to an embodiment of the disclosure, the refrigerator further includes an elastic member to connect the rack gear to the second case, wherein in response to the rack gear being maximally moved in a direction in which the second case moves toward the first case, the elastic member is tensioned and airtightness between the second case and the first case is maintained by an elastic restoring force.

According to an embodiment of the disclosure, the refrigerator further includes a first ejector including a pressing portion, wherein the first case includes a through hole formed to correspond to a position of the ice-making cell, and the pressing portion is configured to pass through the through hole so as to press the first tray.

According to an embodiment of the disclosure, the first ejector includes a body configured to support the pressing portion, and a leg extending from each of opposite ends of the body and inserted into respective side portions of the cover frame, the second case includes a protrusion extending from each of opposite ends of the second case to be respectively received in the legs, and in response to the second case being moved in a direction away from the first case, the protrusions interfere with the legs, and the first ejector is moved in a direction closer to the first case such that the pressing portion presses the first tray.

According to an embodiment of the disclosure, the refrigerator further includes a second ejector fixed to one side of the cover frame and including a pressing portion extending toward the second case, wherein in response to the second case being moved in a direction away from the first case, the pressing portion of the second ejector passes through the second case so as to press the second tray.

According to an embodiment of the disclosure, the ice-making cells of the first tray and the second tray are each configured in a semi-spherical shape.

According to an embodiment of the disclosure, the refrigerator further includes a cover frame coupled to an inside of the ice making housing; and a water path configured on an upper surface of the cover frame to guide the water supplied from the water supplier to flow into the first tray and the second tray, wherein a plurality of ice-making cells are formed in the first tray and the second tray.

According to an embodiment of the disclosure, the water path includes a plurality of flow paths to equally supply water to each of the plurality of ice-making cells of the first tray and the second tray.

According to an embodiment of the disclosure, the refrigerator controls the water supplier to allow water to be divided and supplied in stages according to a water level of the plurality of ice-making cells.

According to an embodiment of the disclosure, the water path includes a single flow path to guide the water to only one ice-making cell among the plurality of ice-making cells, and each of the plurality of ice-making cells is configured to have a height difference so that the water overflows the one ice-making cell among the plurality of ice-making cells to sequentially fill the remaining ice-making cells among the plurality of ice-making cells with the water.

According to an embodiment of the disclosure, the water path includes a single flow path to guide the water to only one ice-making cell among the plurality of ice-making cells, and the first tray and the second tray include a connection flow path provided to allow the water, which is supplied to the one ice-making cell, to flow to an adjacent ice-making cell among the plurality of ice-making cells.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
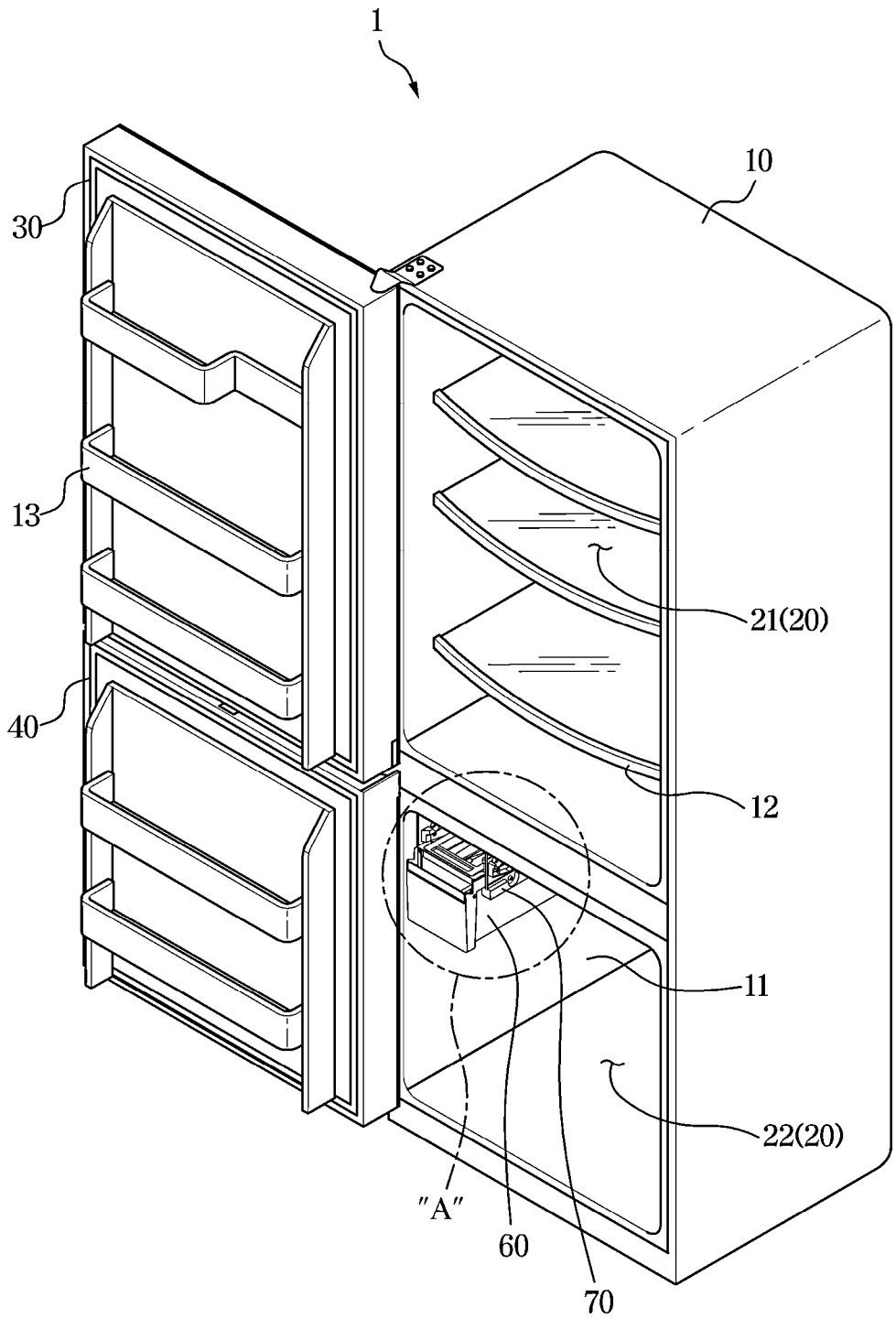
FIG. 1 is a perspective view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "up and down direction", "lower side", "front and rear direction" and the like may be defined by the drawings, but the shape and the location of the component is not limited by the term.

Embodiments of the disclosure may be directed to providing a refrigerator including an improved structure in which a plurality of trays are movable to be in horizontal contact with each other to make ice. Embodiments of the disclosure may be directed to providing a refrigerator including a sealing portion to maintain a seal between a plurality of horizontally coupled trays when ice is formed. Embodiments of the disclosure may be directed to providing a refrigerator capable of increasing a transparency of ice to be formed.

An ice storage space under a plurality of trays may be increased because the plurality of trays are horizontally coupled to each other and separated from each other. By increasing airtightness between a plurality of trays, it is possible to form ice in a neat sphere shape and to minimize crumbs of the ice. By supplying water step by step according to a water level in an ice making cell, it is possible to ensure transparency of ice.

Hereinafter embodiments of the disclosure will be described in detail with reference to the accompanying drawings.

Figure 2:
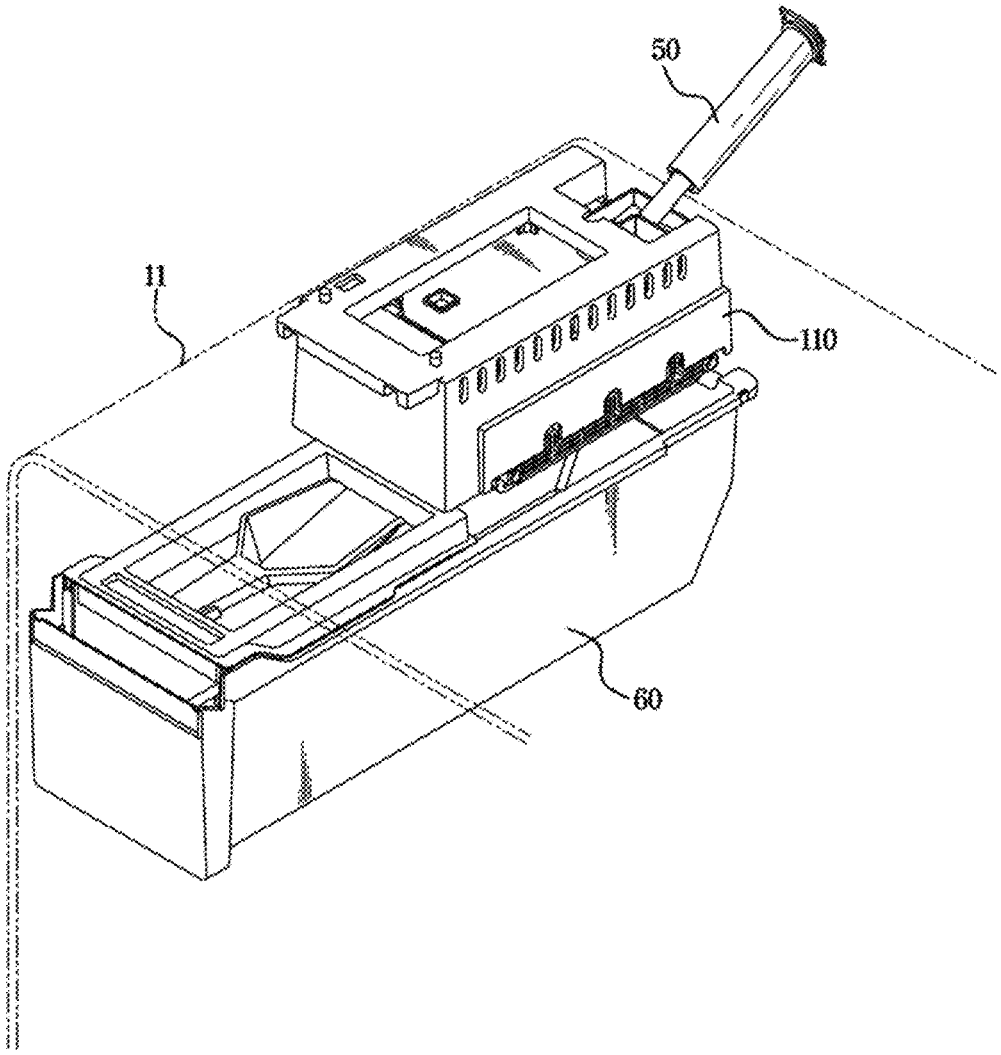
FIG. 2 is an enlarged view of some components of the refrigerator according to ab embodiment of the disclosure.

FIG. 1 is a perspective view of a refrigerator according to one embodiment of the present disclosure. FIG. 2 is an enlarged view of some components of the refrigerator according to one embodiment of the present disclosure.

Referring to FIGS. 1 and 2, a refrigerator 1 may include a main body 10, a storage compartment 20 provided inside the main body 10, and a door configured to open and close the storage compartment 20.

A bottom mount freezer (BMF) refrigerator 1, in which a refrigerating compartment 21 is provided at an upper side and a freezing compartment 22 is provided at a lower side, will be described as an example of the refrigerator 1 according to one embodiment of the present disclosure. However, the present disclosure is not limited thereto, but may be applied to various types of refrigerators 1 such as a top mount freezer (TMF) refrigerator 1, a French door (FDR) refrigerator 1, a 4DOOR type refrigerator 1, and a side-by-side (SBS) refrigerator 1.

The storage compartment 20 may include the refrigerating compartment 21 and the freezing compartment 22.

At least one shelf 12 for loading food or goods may be installed inside the refrigerating compartment 21. In addition, a storage container (not shown) for storing fresh foods may be provided inside the refrigerating compartment 21.

The refrigerating compartment 21 may be opened and closed by a refrigerating compartment door 30, and the refrigerating compartment door 30 may be rotatably mounted on the main body 10. The refrigerating compartment door 30 may be configured to open and close an open front surface of the refrigerating compartment 21. The refrigerating compartment door 30 is hinged to the main body 10 so as to be rotatable forward.

The freezing compartment 22 may be opened and closed by a freezing compartment door 40. The freezing compartment door 40 may be rotatably mounted on the main body 10. The freezing compartment door 40 is configured to open and close an open front surface of the freezing compartment 22. The freezing compartment door 40 is hinged to the main body 10 so as to be rotatable forward.

Door guards 13 for storing objects may be installed on inner surfaces of the refrigerating compartment door 30 and the freezing compartment door 40. The door guard 13 may be provided in plurality.

The inside of the refrigerator 1 may be cooled by a refrigeration cycle and maintained at a low temperature. Although not particularly shown, the refrigeration cycle may be configured to independently supply a refrigerant to the refrigerating compartment 21 and the freezing compartment 22. The refrigerator 1 may include a compressor configured to compress a refrigerant and a condenser configured to condense the compressed refrigerant, and thus the refrigerant condensed in the condenser may be supplied along a flow path.

The refrigerator 1 may include a mounting frame 70. The mounting frame 70 may be coupled to an inner case 11 of the freezing compartment 22.

An ice making assembly 1000 (shown in FIG. 3) for making ice using cold air in the freezing compartment 22 may be disposed on one side of the freezing compartment 22. In addition, an ice bucket 60 provided to store ice formed by the ice making assembly 1000 may be mounted on the mounting frame 70.

FIG. 2 illustrates a state in which an ice making housing 110 and the ice bucket 60 are arranged in the freezing compartment 22 without the mounting frame 70.

The ice making assembly 1000 may be accommodated inside the ice making housing 110 and the ice making housing 110 may be mounted on the mounting frame 70. That is, the ice making housing 110 and the ice bucket 60 may be mounted on the mounting frame 70.

The refrigerator 1 may include a water supplier 50. The water supplier 50 may be configured to receive water from an external water supply source and deliver the water. Particularly, the water supplier 50 may be provided to receive water from the outside and deliver the water to the inside of the ice making assembly 1000. The water supplier 50 may pass through the inner case 11 of the refrigerator 1 and communicate with the storage compartment 20. Accordingly, a portion of the water supplier 50 may be embedded in a heat insulating material, and only one end of the water supplier 50 may be exposed to the storage compartment 20 of the refrigerator 1.

Figure 3:
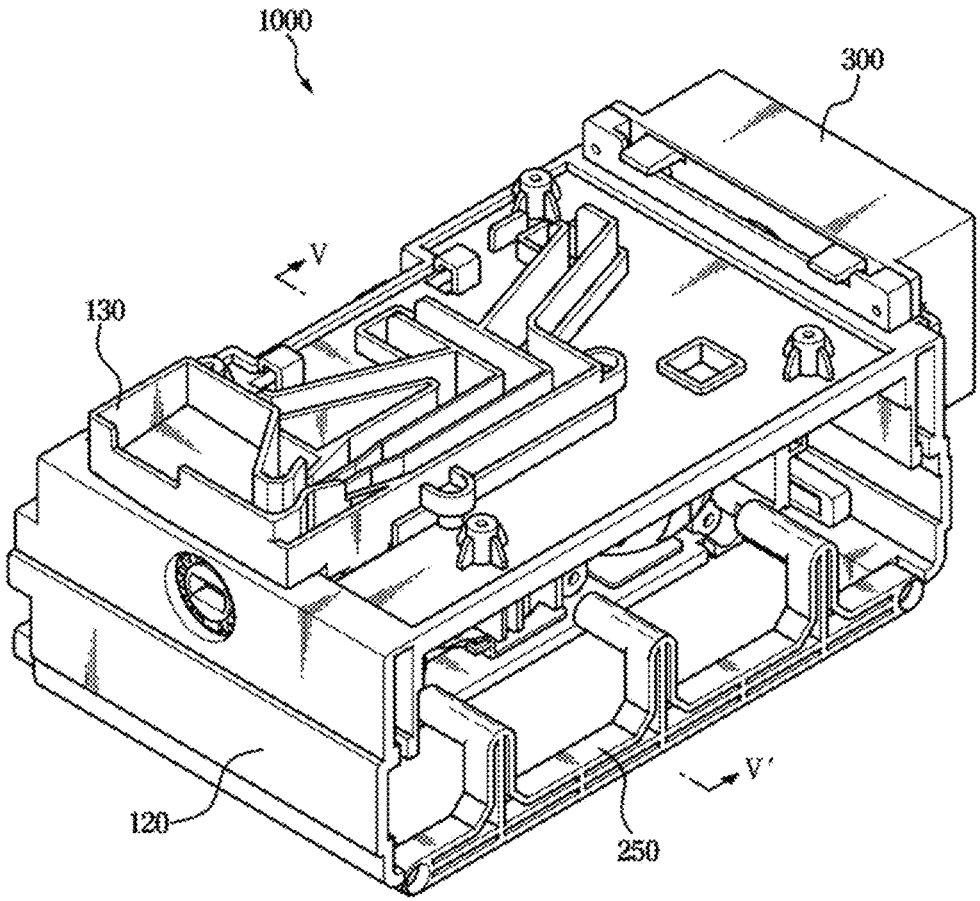
FIG. 3 is a view of an ice making assembly of the refrigerator according to an embodiment of the disclosure.
Figure 4:
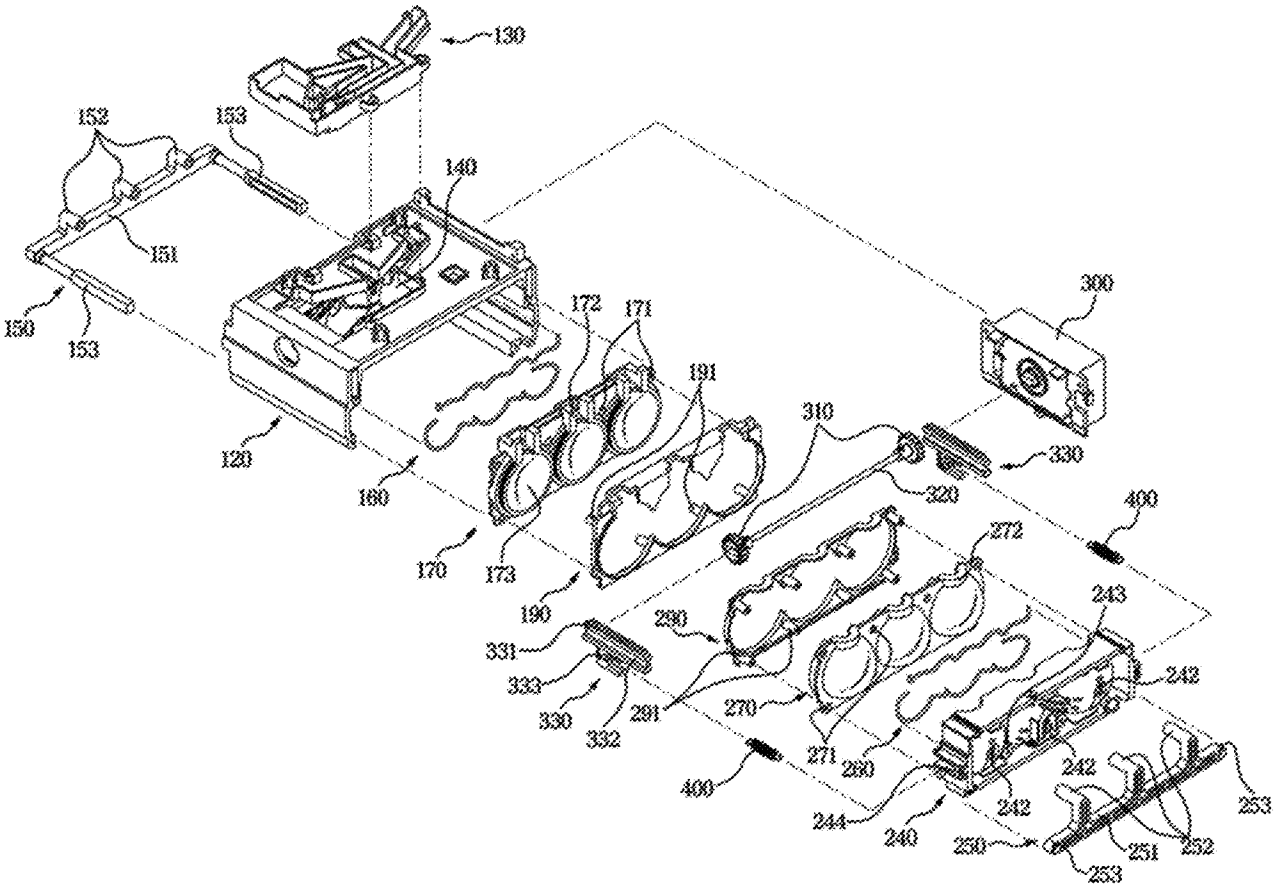
FIG. 4 is an exploded perspective view of the ice making assembly of FIG. 3 according to an embodiment of the disclosure.

FIG. 3 is a view of an ice making assembly of the refrigerator according to one embodiment of the present disclosure. FIG. 4 is an exploded perspective view of the ice making assembly of FIG. 3.

Referring to FIGS. 3 and 4, the ice making assembly 1000 may include a cover frame 120. The cover frame 120 may be provided to be coupled to the ice making housing 110 inside the ice-making housing 110 (refer to FIG. 2). The cover frame 120 may be provided in a box shape in which one side surface and a lower surface are open.

The ice making assembly 1000 may include a water path 130. The water path 130 may be mounted on one side of the cover frame 120. Particularly, the water path 130 may be mounted on an upper surface of the cover frame 120. The water path 130 may be provided to allow water, which is supplied from the water supplier 50, to flow to the inside of the cover frame 120. In other words, the water path 130 may be provided to allow water, which is supplied from the water supplier 50, to flow to an inside of a first tray 170 and a second tray 270.

The ice making assembly 1000 may include a first case 140 formed on the cover frame 120, and the first tray 170, a first fixing frame 190, and a first heating wire 160 that are accommodated in the first case 140.

The first case 140 may be formed on one surface of the cover frame 120. The first case 140 may be integrally formed with the cover frame 120, but may be provided as a separate member and then coupled to one surface of the cover frame 120.

The first case 140 may be provided to accommodate the first tray 170. A detailed structure of the first case 140 will be described later with reference to FIG. 8.

The first tray 170 may be provided inside the ice making housing 110. Particularly, the first tray 170 may be mounted inside the cover frame 120. The first tray 170 may be formed of a material having elasticity.

The first tray 170 may receive water from the water supplier 50. The first tray 170 may include a first guide 172 to allow the supplied water to flow into an ice-making cell inside the first tray 170. The first guide 172 may be formed on an upper side of the first tray 170.

The first tray 170 may include a first ice-making cell 173 provided to make a portion of ice. The first ice-making cell 173 may be provided in a substantially circular or semi-spherical shape. Accordingly, ice formed in the ice making assembly 1000 may be in a spherical shape. It is described that the ice making assembly 1000 of the refrigerator 1 according to one embodiment of the present disclosure includes three first ice-making cells 173, but the number of first ice-making cells 173 is not limited thereto.

The first tray 170 may include a first insertion hole 171. The first insertion hole 171 may be provided in plurality.

The first insertion hole 171 may be provided to allow a first coupling protrusion 191 of the first fixing frame 190 to be inserted thereinto. Accordingly, the first fixing frame 190 may fix the first tray 170 to the first case 140. In other words, the first fixing frame 190 may fix the first tray 170 to one surface of the cover frame 120.

The first fixing frame 190 may include the first coupling protrusion 191. The first coupling protrusion 191 may be provided in plurality in accordance with the number of first insertion holes 171. The first coupling protrusion 191 may extend toward the first tray 170 from one surface of the first fixing frame 190. The first coupling protrusion 191 may also be inserted into a first through hole 142 of the first case 140 to be described later and coupled to the first case 140.

The first fixing frame 190 may be provided to support an edge of the first ice-making cell 173 of the first tray 170. Because the first tray 170 is formed of a material having elasticity, the first fixing frame 190 may reinforce an insufficient rigidity of the first tray 170.

The ice making assembly 1000 may include the first heating wire 160. The first heating wire 160 may be disposed between the first tray 170 and the first case 140. Particularly, the first heating wire 160 may be disposed between the first tray 170 and the cover frame 120. By placing the first heating wire 160 to one surface of the first tray 170, the ice may be easily separated from the first ice-making cell 173 after ice formation is completed in the first ice-making cell 173 of the first tray 170.

Therefore, the first case 140 formed on one surface of the cover frame 120, and the first heating wire 160, the first tray 170, and the first fixing frame 190 may be fixed to one side of the cover frame 120.

The ice making assembly 1000 may include a second case 240, and the second tray 270, a second fixing frame 290, and a second heating wire 260 that are accommodated in the second case 240.

The second case 240 may be configured to be moved inside the cover frame 120.

The second case 240 may be provided to accommodate the second tray 270.

The second case 240 may include a second tray receiving member 241. The second tray receiving member 241 may be provided to accommodate a second ice-making cell 273 of the second tray 270. Three second tray receiving members 241 may be provided in accordance with the number of second ice-making cells 273.

The second case 240 may include a second through hole 242. The second through hole 242 may be formed by cutting the second tray receiving member 241. The second through hole 242 may be provided to allow a pressing portion of a second ejector 250 to be described later to pass therethrough.

The second case 240 may include a second fixer 243. The second fixer 243 may be provided to allow a second coupling protrusion 291 of the second fixing frame 290 to be described later to be inserted thereinto.

The second case 240 may include a second elastic member mounting member 244. An elastic member 400 connecting a rack gear 330 to be described later and the second case 240 may be mounted on the second elastic member mounting member 244.

The second case 240 may include a protrusion 245. The protrusion 245 may extend outward from a side surface of the second case 240. The protrusion 245 may be inserted into a leg 153 of a first ejector 150 to be described later. A detail description thereof will be described later.

The second tray 270 may be disposed inside the ice making housing 110. Particularly, the second tray 270 may be mounted inside the cover frame 120. The second tray 270 may be formed of a material having elasticity. The second tray 270 may be provided to make the rest of the ice by being engaged with the first tray 170.

The second tray 270 may receive water from the water supplier 50. The second tray 270 may include a second guide 272 to allow the supplied water to flow into the second ice-making cell 273 inside the second tray 270. The second guide 272 may be formed on an upper side of the second tray 270.

The second tray 270 may include the second ice-making cell 273 provided to form the remaining portion of the ice. The second ice-making cell 273 may be provided in a substantially circular shape. Accordingly, the ice formed in the ice making assembly 1000 may be in a spherical shape. It is described that the ice making assembly 1000 of the refrigerator 1 according to one embodiment of the present disclosure includes three second ice-making cells 273, but the number of second ice-making cells 273 is not limited thereto.

The second tray 270 may include a second insertion hole 271. The second insertion hole 271 may be provided in plurality.

The second insertion hole 271 may be provided to allow the second coupling protrusion 291 of the second fixing frame 290 to be inserted thereinto. Accordingly, the second fixing frame 290 may fix the second tray 270 to the second case 240. In other words, the second fixing frame 290, the second tray 270, and the second case 240 may be integrally driven.

The second fixing frame 290 may include the second coupling protrusion 291. The second coupling protrusions 291 may be provided in plurality in accordance with the number of second insertion holes 271. The second coupling protrusion 291 may extend toward the second tray 270 from one surface of the second fixing frame 290. The second coupling protrusion 291 may also be inserted into the second through hole 242 of the second case 240 and coupled to the second case 240. That is, the second coupling protrusion 291 may pass through the second insertion hole 271 of the second tray 270 and be coupled to the second through hole 242 of the second case 240.

The second fixing frame 290 may be provided to support an edge of the second ice-making cell 273 of the second tray 270. Because the second tray 270 is formed of a material having elasticity, the second fixing frame 290 may reinforce an insufficient rigidity of the second tray 270.

The ice making assembly 1000 may include the second heating wire 260. The second heating wire 260 may be disposed between the second tray 270 and the second case 240. By placing the second heating wire 260 to one surface of the second tray 270, the ice may be easily separated from the second ice-making cell 273 after ice formation is completed in the second ice-making cell 273 of the second tray 270.

Accordingly, the second case 240, the second heating wire 260, the second tray 270, and the second fixing frame 290 are provided to move integrally on the other side of the cover frame 120. In addition, the second case 240, the second heating wire 260, the second tray 270, and the second fixing frame 290 are provided to be moved horizontally with respect to the cover frame 120. In other words, the second tray 270 provided to form ice is configured to be moved horizontally with respect to the first tray 170.

The ice making assembly 1000 may include the first ejector 150 and a second ejector 250.

The first ejector 150 may be provided to press the first tray 170. Particularly, the first ejector 150 may be provided to press the first ice-making cell 173 of the first tray 170.

The first ejector 150 may be provided to pass through the first through hole 142 formed in the first case 140 to be described later. Particularly, a first pressing portion 152 of the first ejector 150 may be provided to press the first tray 170 by passing through the first through hole 142.

The first ejector 150 may be configured to be moved with respect to the cover frame 120. The first ejector 150 may be movable based on the movement of the second case 240. A detail description of the coupling of the first ejector 150 and the second case 240 will be described later.

The second ejector 250 may be fixed to one side of the cover frame 120. The second ejector 250 may be configured to press the second tray 270. Particularly, the second ejector 250 may be configured to press the second ice-making cell 273 of the second tray 270.

The second ejector 250 may include a second body 251, a second pressing portion 252, and a frame coupler 253. The second body 251 may extend in a direction parallel to the second case 240. The second pressing portion 252 may extend from the second body 251 toward the second case 240. The frame coupler 253 may be formed at opposite ends of the second body 251 and coupled to the cover frame 120.

The second ejector 250 may be provided to pass through the second through hole 242 formed in the second case 240. Particularly, the second pressing portion 252 of the second ejector 250 may pass through the second through hole 242 and press the second tray 270.

That is, as the second ejector 250 is fixed to the cover frame 120 and the second tray 270 is moved with respect to the cover frame 120, the second ejector 250 may press the second tray 270.

The ice making assembly 1000 may include the driver 300, a pinion 310, a bar 320, a rack gear 330, and the elastic member 400.

The driver 300 may be configured to generate power. Various electrical components such as a motor and a circuit board may be disposed inside the driver 300. The driver 300 may be coupled to the cover frame 120.

The pinion 310 may be coupled to the driver 300 to transmit power generated from the driver 300. The pinion 310 may be provided as a pair. A pair of pinions 310 may be connected by the bar 320. The pinion 310 may be provided to be rotated according to driving of the driver 300. The pinion 310 may be provided in a sawtooth shape to engage with the rack gear 330.

The rack gear 330 may be provided to be movable with respect to the cover frame 120. Particularly, based on the rotational motion of the pinion 310, the rack gear 330 may move linearly.

The rack gear 330 may include a support member 332 supported by the cover frame 120. The rack gear 330 may include a toothed member 331 formed on an upper surface of the support member 332. The toothed member 331 of the rack gear 330 and the pinion 310 may be engaged and thus the rack gear 330 may be moved horizontally with respect to the cover frame 120.

The rack gear 330 may include a first elastic member mounting member 333 extending from the support member 332. The elastic member 400 to be described later may be mounted on the first elastic member mounting member 333.

That is, the pinion 310 and the rack gear 330 are meshed with each other to convert a rotational motion of the driver 300 into a linear motion. However, embodiments of the present disclosure are not limited thereto, and any structure capable of converting a rotational motion into a linear motion may be applied.

The elastic member 400 may be provided to connect the rack gear 330 and the second case 240. That is, the rack gear 330 and the second case 240 may be connected.

Accordingly, as the rack gear 330 receives power from the driver 300 and moves, the second case 240 may be moved horizontally with respect to the cover frame 120 in conjunction with the rack gear 330. In other words, the second tray 270 and the second case 240 may be linearly moved with respect to the cover frame 120 by the rack gear 330.

That is, as the movement of the second case 240 is acted integrally with the second tray 270, the second heat wire 260, and the second fixing frame 290, the second tray 270 may be moved horizontally with respect to the first tray 170.

Figure 5:
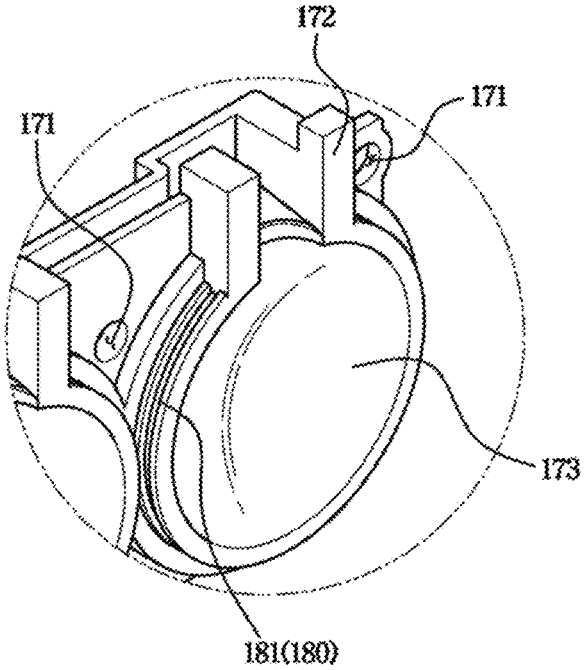
FIG. 5 is an enlarged view of a part of a first tray of the refrigerator according to an embodiment of the disclosure.
Figure 6:
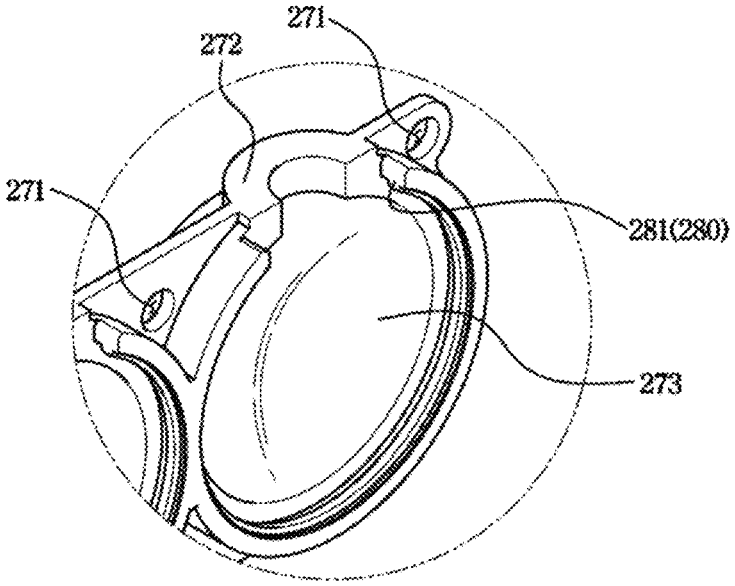
FIG. 6 is an enlarged view of a part of a second tray of the refrigerator according to an embodiment of the disclosure.
Figure 7:
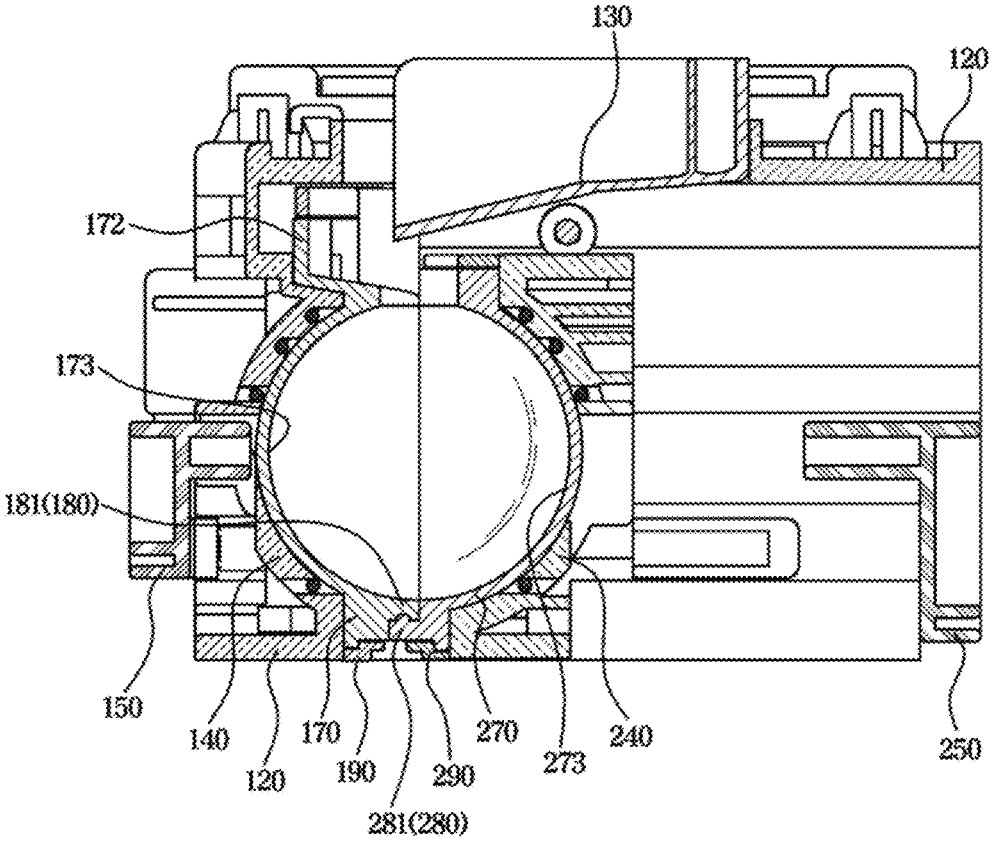
FIG. 7 is a cross-sectional view illustrating a state in which the first tray and the second tray of the refrigerator according to an embodiment of the disclosure are coupled.

FIG. 5 is an enlarged view of a part of a first tray of the refrigerator according to one embodiment of the present disclosure. FIG. 6 is an enlarged view of a part of a second tray of the refrigerator according to one embodiment of the present disclosure. FIG. 7 is a cross-sectional view illustrating a state in which the first tray and the second tray of the refrigerator according to one embodiment of the present disclosure are coupled.

Referring to FIGS. 5 to 7, the ice making assembly 1000 may include a first sealing portion 180 and a second sealing portion 280.

The first sealing portion 180 may be formed along the edge of the first ice-making cell 173 of the first tray 170. The first sealing portion 180 may include a recess 181 recessed inward from an outer circumferential surface of the first tray 170. The recess 181 may be formed by being recessed inward from an outer side with respect to a radial direction of the first ice-making cell 173.

The second sealing portion 280 may be formed along an edge of the second ice-making cell 273 of the second tray 270. The second sealing portion 280 may be provided to overlap the first sealing portion 180. That is, the second sealing portion 280 may be provided to overlap a part of the first tray 170.

The second sealing portion 280 may include a protrusion 281 extending outward from an inner circumferential surface of the second tray 270. The protrusion 281 may be provided to be seated on the recess 181 to maintain a seal between the first tray 170 and the second tray 270. Particularly, the protrusion 281 of the second tray 270 may be provided to surround the recess 181 of the first tray 170, and thus a sealing force in a portion, in which the first tray 170 and the second tray 270 are in contact with each other, may be improved.

In other words, the first sealing portion 180 may be coupled to the second sealing portion 280 in such a way that the second sealing portion 280 formed in the second ice-making cell 273 overlaps the inside of the first sealing portion 180 formed in the first ice-making cell 173. That is, the second ice-making cell 273 may be coupled to the first ice-making cell 173 so as to overlap the inside of a partition wall of the first ice-making cell 173 to maintain an internal seal.

In the refrigerator 1 according to one embodiment of the present disclosure, it is described that the first sealing portion 180 includes the recess 181 and the second sealing portion 280 includes the protrusion 281, but it is not limited. Alternatively, the first sealing portion 180 may include the protrusion 281 and the second sealing portion 280 may include the recess 181. That is, it is sufficient that the first sealing portion 180 and the second sealing portion 280 have overlapping portions to maintain the sealing force.

Figure 8:
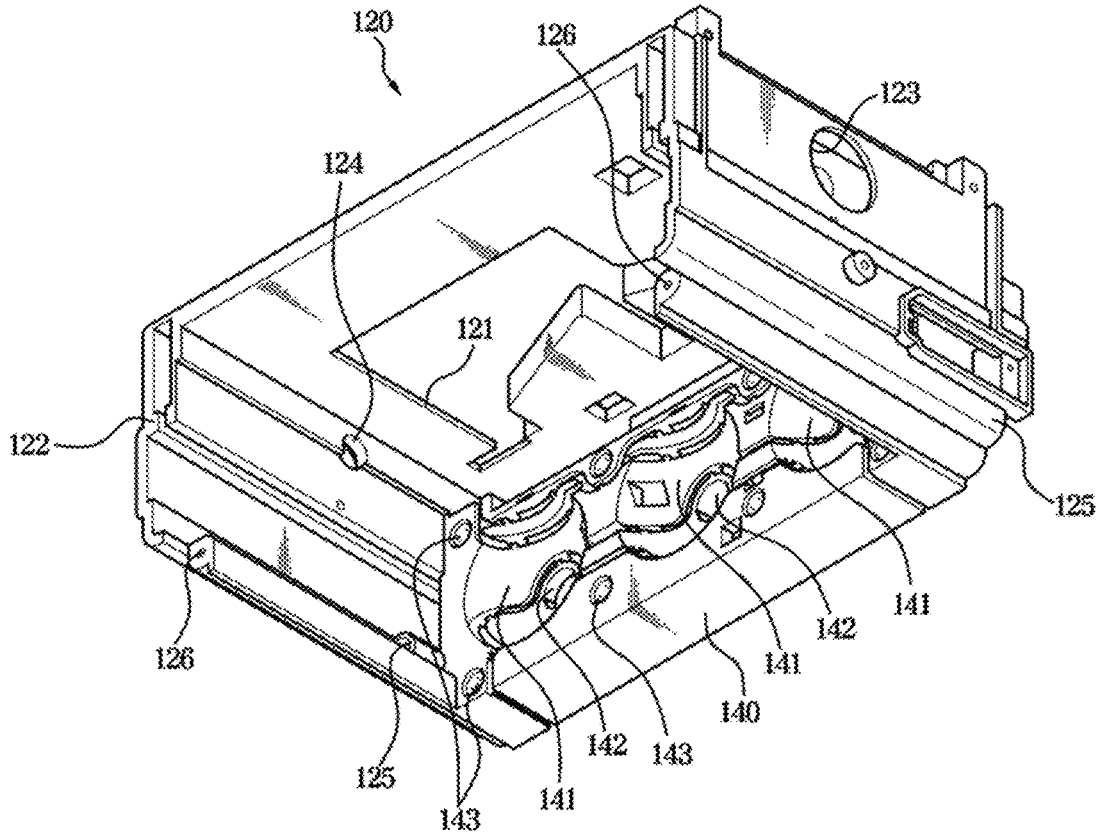
FIG. 8 is a bottom perspective view of a cover frame of the refrigerator according to an embodiment of the disclosure.

FIG. 8 is a bottom perspective view of a cover frame of the refrigerator according to one embodiment of the present disclosure.

Referring to FIG. 8, the cover frame 120 may include a cutout 121. The cutout 121 may be formed on the upper surface of the cover frame 120 to provide a space in which the water path 130 is mounted.

The cover frame 120 may include a pinion receiving member 123, a bar through hole 124, and a gear mounting member 122.

The pinion receiving member 123 may be formed to be open on a side surface of the cover frame 120. Accordingly, power of the driver 300 may be transmitted to the pinion 310.

The bar through hole 124 may be formed on the inner surface of the cover frame 120. As the pair of pinions 310 are disposed on opposite sides of the cover frame 120, respectively, the bar 320 provided to connect the pair of pinions 310 may pass through the bar through hole 124.

The gear mounting member 122 may be formed by the inner and outer surfaces of the cover frame 120. The inner and outer surfaces of the cover frame 120 may be spaced apart from each other by a predetermined distance, and thus the rack gear 330 may be received therein. A part of the rack gear 330 may be inserted into the gear mounting member 122 and thus the rack gear 330 may be movable relative to the cover frame 120.

The cover frame 120 may include an ejector supporter 125 and an ejector coupler 126.

The ejector supporter 125 may be formed on a lower portion of a side surface of the cover frame 120. The first ejector 150 may be inserted into the ejector supporter 125 to be movable relative to the cover frame 120.

The ejector coupler 126 may be formed on a lower portion of a side surface of the cover frame 120 and may be provided to face the outside of the cover frame 120. The second ejector 250 may be coupled to the ejector coupler 126. Accordingly, the second ejector 250 may be fixed to the cover frame 120.

The first case 140 may be formed on one surface of the cover frame 120.

The first case 140 may include a first tray receiving member 141. The first tray receiving member 141 may be provided to receive the first ice-making cell 173 of the first tray 170. Three first tray receiving members 141 may be provided in accordance with the number of first ice-making cells 173.

The first case 140 may include the first through hole 142. The first through hole 142 may be formed by cutting the first tray receiving member 141. The first through hole 142 may be provided to allow a pressing portion, to be described later, of the first ejector 150 to pass therethrough.

The first case 140 may include a first fixer 143. The first fixer 143 may be provided to allow the above-described first coupling protrusion 191 of the first fixing frame 190 to be inserted thereinto. The first fixer 143 may be provided in plurality in accordance with the number of first coupling protrusions.

The first case 140 may be integrally formed with the cover frame 120 as described in the present embodiment. Alternatively, the first case 140 may be provided as a component separated from the cover frame 120 and fixedly mounted to the cover frame 120.

Figure 9:
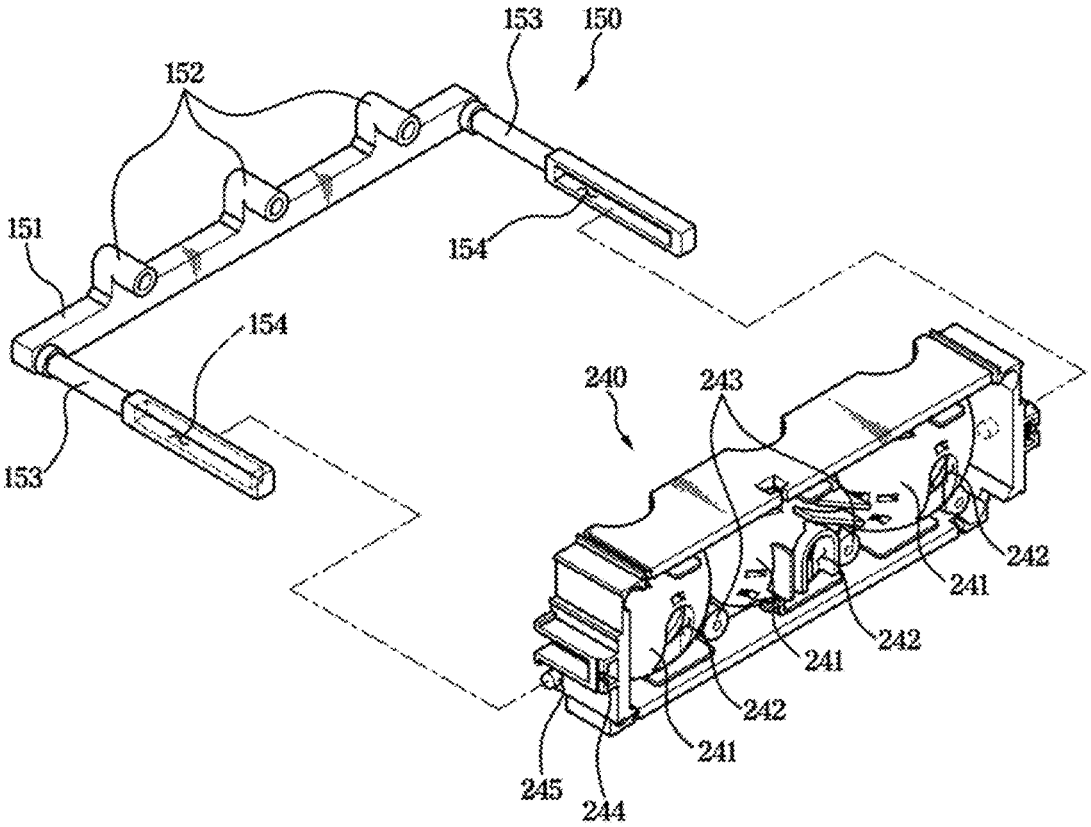
FIG. 9 is an exploded perspective view illustrating a coupling between a first ejector and a second case of the refrigerator according to an embodiment of the disclosure.

FIG. 9 is an exploded perspective view illustrating a coupling between a first ejector and a second case of the refrigerator according to one embodiment of the present disclosure.

Referring to FIG. 9, the first ejector 150 may include a first body 151, the first pressing portion 152 and the leg 153.

The first body 151 may be formed to extend in a direction parallel to the second case 240. That is, the first body 151 may extend along a direction perpendicular to the moving direction of the first ejector 150.

The first pressing portion 152 may be provided to extend from the first body 151. The first body 151 may be provided to support the first pressing portion 152. The first pressing portion 152 may pass through the first through hole 142 of the first case 140 and press the first tray 170. Particularly, the first pressing portion 152 may be provided to press each of the first ice-making cells 173 of the first tray 170. Therefore, the number of first pressing portions 152 may be in accordance with the number of first ice-making cells 173.

The leg 153 may extend from opposite ends of the first body 151 and be inserted into the side part of the cover frame 120. The inserted leg 153 may be supported by the ejector supporter 125 of the cover frame 120 described above. The leg 153 may extend along a direction parallel to the moving direction of the first ejector 150. The leg 153 may be provided as a symmetrical pair.

The leg 153 may include a protrusion receiving space 154. The protrusion receiving space 154 may be formed at an end of the leg 153. The protrusion 245 of the second case 240 may be received in the protrusion receiving space 154.

The second case 240 may include the protrusion 245 extending toward the leg 153 from a side surface of the second case 240. The protrusion 245 may be received in the leg 153.

Accordingly, when the second case 240 moves in a direction away from the first case 140, the protrusion 245 may interfere with the leg 153 and thus the first ejector 150 may also move along the moving direction of the second case 240. That is, because the first case 140 is disposed between the first ejector 150 and the second case 240, the first ejector 150 may move in a direction closer to the first case 140.

In addition, when the second case 240 moves in a direction closer to the first case 140, the protrusion 245 may interfere with the leg 153 and thus the first ejector 150 may also move along the moving direction of the second case 240. That is, because the first case 140 is disposed between the first ejector 150 and the second case 240, the first ejector 150 may move in a direction away from the first case 140.

A detailed description of the movement of the first ejector 150 will be described later.

Figure 10:
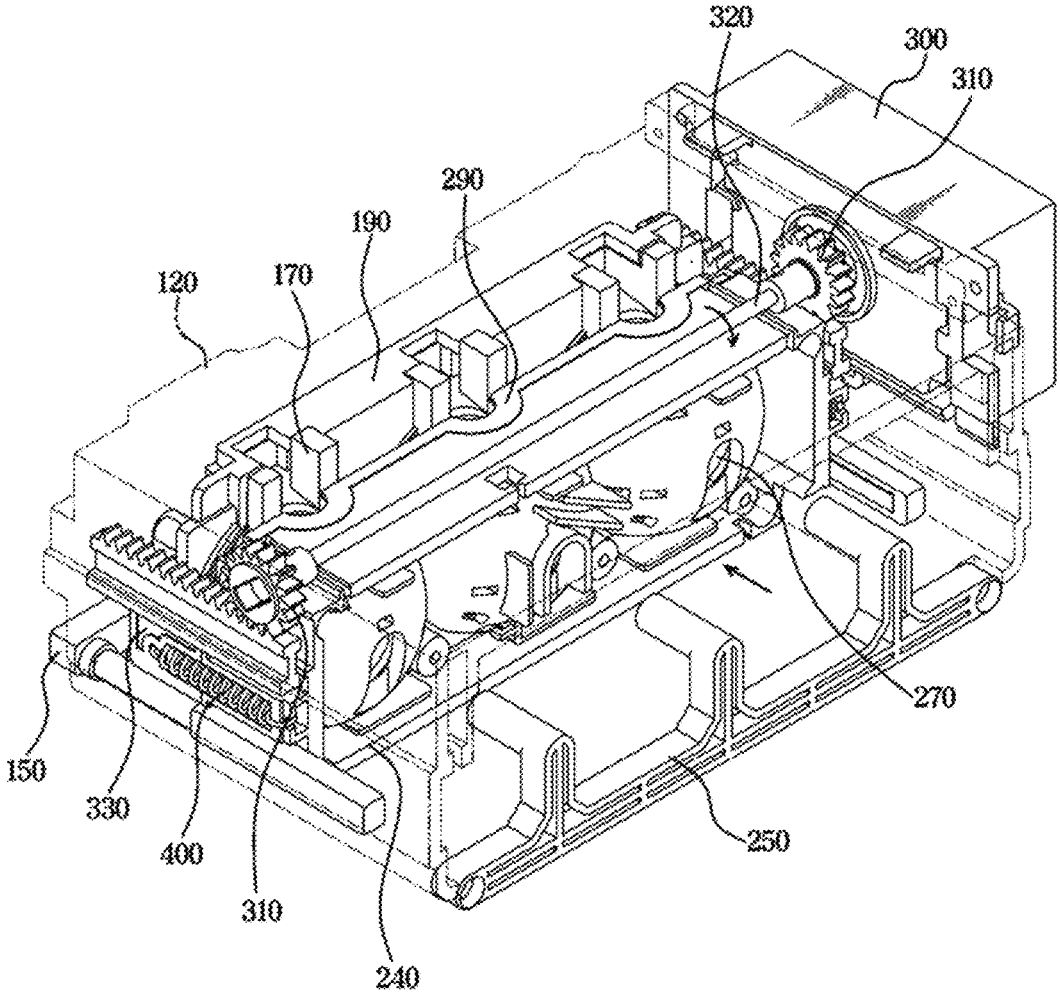
FIG. 10 is a view illustrating a first state of the ice making assembly of the refrigerator according to an embodiment of the disclosure.
Figure 11:
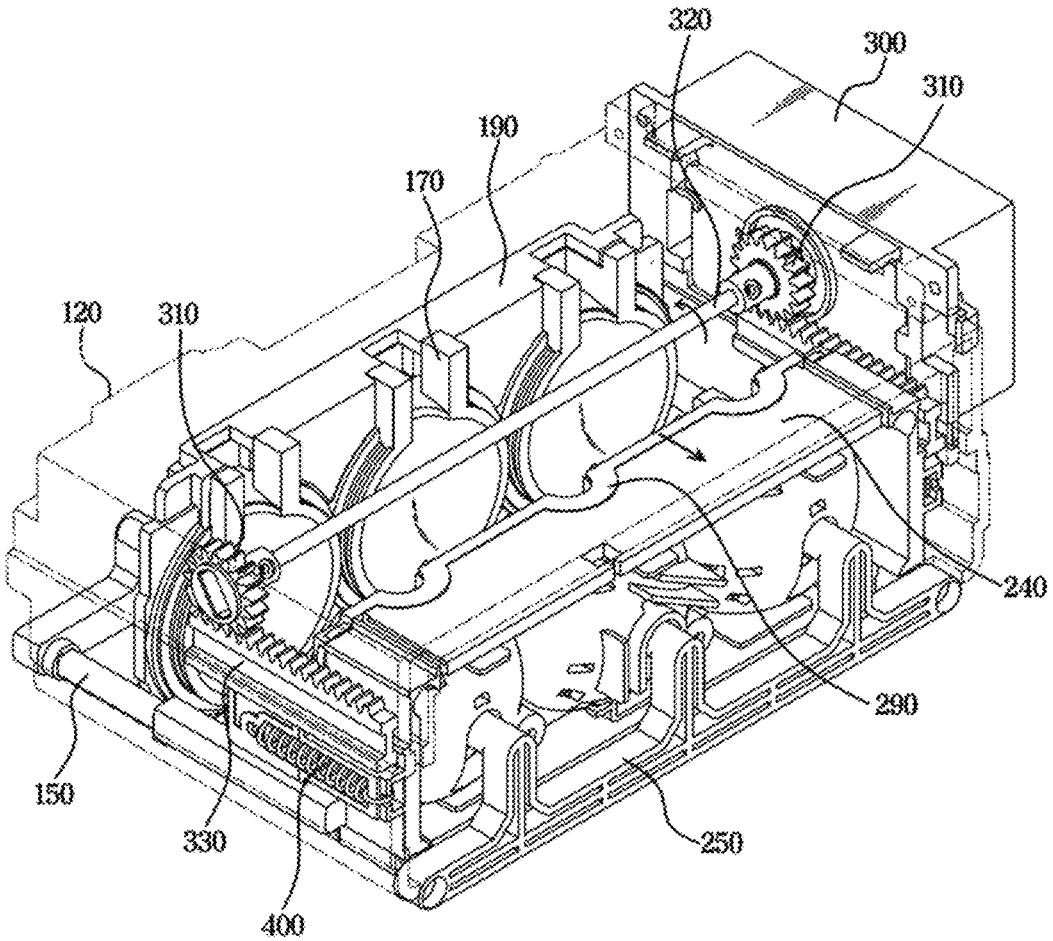
FIG. 11 is a view illustrating a second state of the ice making assembly of the refrigerator according to an embodiment of the disclosure.
Figure 12:
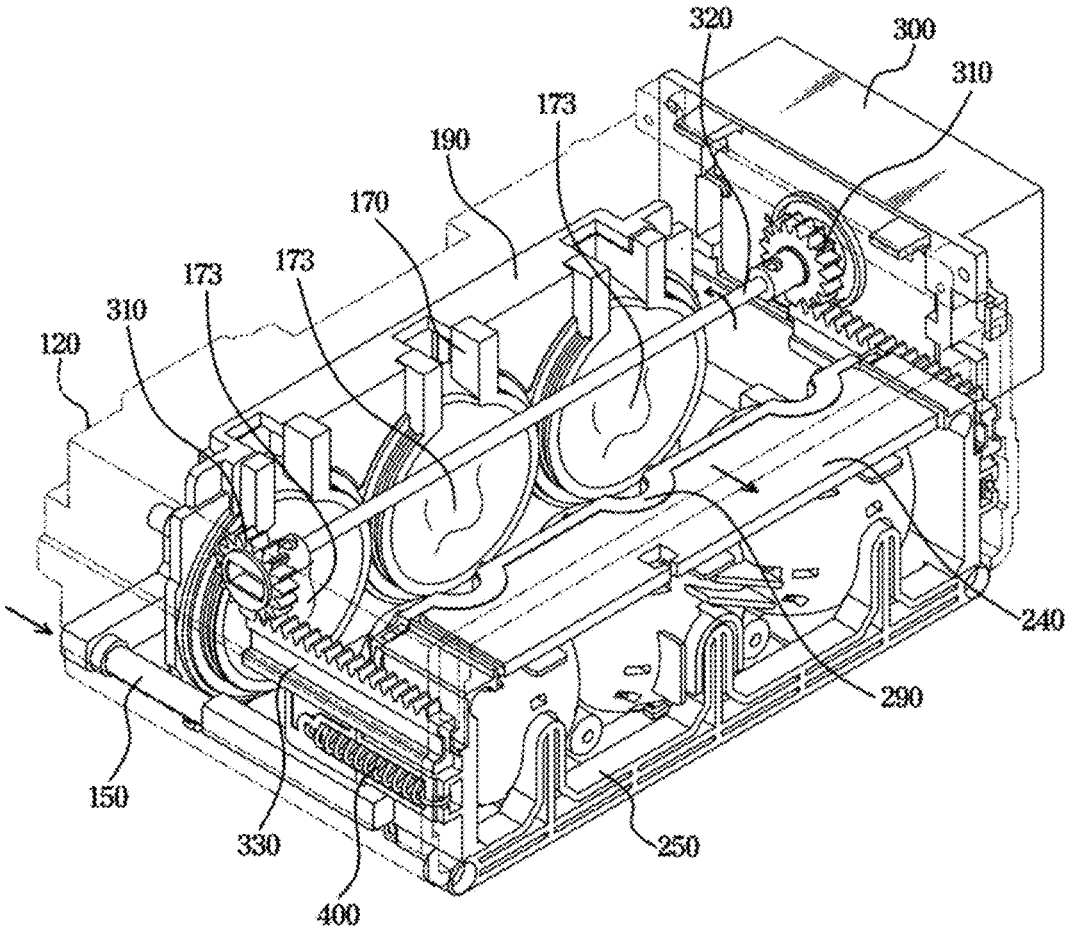
FIG. 12 is a view illustrating a third state of the ice making assembly of the refrigerator according to an embodiment of the disclosure.

FIG. 10 is a view illustrating a first state of the ice making assembly of the refrigerator according to one embodiment of the present disclosure. FIG. 11 is a view illustrating a second state of the ice making assembly of the refrigerator according to one embodiment of the present disclosure. FIG. 12 is a view illustrating a third state of the ice making assembly of the refrigerator according to one embodiment of the present disclosure.

As illustrated in FIG. 10, when the pinion 310 and the bar 320 are rotated clockwise by the driver 300, the rack gear 330 and the second case 240 connected to the rack gear 330 may be moved to one side of the cover frame 120. In other words, the second case 240 is moved in a direction closer to the first case 140.

A state, in which the first tray 170 and the second tray 270 are engaged to maintain the airtightness as the second case 240 is moved, is referred to as a first state.

That is, the first state may indicate a position of the ice making assembly 1000 in a stage in which ice is formed.

Figure 14:
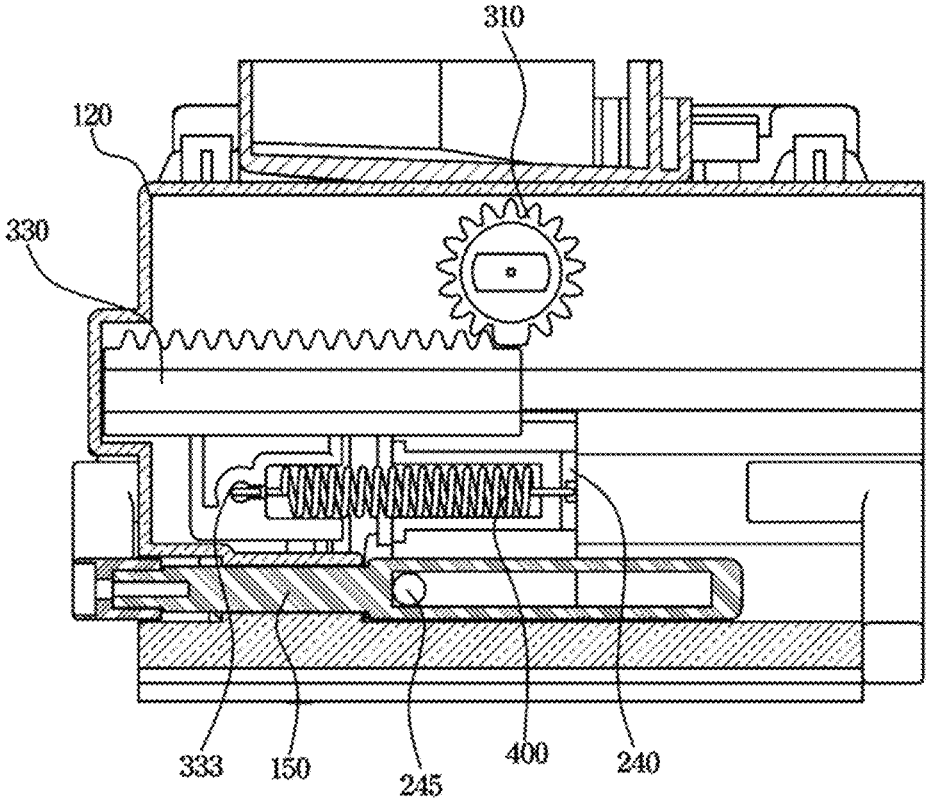
FIG. 14 is a side cross-sectional view illustrating a state in which the rack gear is maximally moved in the ice making assembly in the first state of FIG. 10 according to an embodiment of the disclosure.

The first state may include a state in which the rack gear 330 is not maximally moved with respect to the pinion 310, as illustrated in FIG. 10, and a state in which the rack gear 330 is maximally moved with respect to the pinion 310, as illustrated in FIG. 14 to be described later.

In two states described above, the relative positions of the second case 240 and the second tray 270 and the first case 140 and the first tray 170 are the same, and only the position of the rack gear 330 is changed. Accordingly, the above two states are defined as the same first state.

When the airtightness is maintained between the first tray 170 and the second tray 270 in the first state, water may be supplied from the water supplier 50 to the inside of the first tray 170 and the second tray 270. In other words, ice may be formed inside the first ice-making cell 173 of the first tray 170 and the second ice-making cell 273 of the second tray 270. The ice may be formed in a spherical shape according to the shapes of the first ice-making cell 173 and the second ice-making cell 273.

As illustrated in FIG. 11, when ice formation is completed inside the first ice-making cell 173 and the second ice-making cell 273, the pinion 310 and the bar 320 may be rotated counterclockwise by the driver 300. Accordingly, the rack gear 330 and the second case 240 connected to the rack gear 330 are moved to the other side of the cover frame 120. In other words, the second case 240 is moved in a direction away from the first case 140.

A state, in which the first tray 170 is separated from the second tray 270 as the second case 240 is moved, is referred to as a second state.

In the second state, the second ejector 250 passes through the second through hole 242 of the second case 240. As the second ejector 250 is fixed to the cover frame 120 and the second case 240 is moved toward the second ejector 250, the second ejector 250 may pass through the second case 240.

In the second state, the first ejector 150 is in a state of not passing through the first through hole 142 of the first case 140.

After the second state, the pinion 310 and the bar 320 may be further rotated counterclockwise by the driver 300 as illustrated in FIG. 12. Accordingly, the rack gear 330 and the second case 240 connected thereto are further moved to the other side of the cover frame. In other words, the second case 240 is moved in a direction away from the first case 140.

A state, in which the first ejector 150 is moved in the same direction as the second case 240 as the second case 240 further is moved, is referred to as a third state. That is, the difference between the second state and the third state may be based on whether the first ejector 150 is moved.

In the third state, the first ejector 150 passes through the first through hole 142 of the first case 140. The first case 140 is integrally formed with the cover frame 120 and is fixed thereto. As the second case 240 is moved further toward the second ejector 250, the first ejector 150 may be moved based on the movement of the second case 240.

That is, the second state and the third state may represent positions of the ice making assembly 1000 at a stage in which the formed ice is separated from the first tray 170 and the second tray.

In addition, in the ice making assembly 1000 according to one embodiment of the present disclosure, the second tray 270 may be configured to be moved horizontally with respect to the first tray 170, and thus it is possible to efficiently secure the lower space of the ice making assembly 1000. Accordingly, the storage space of the ice bucket 60 may be increased.

Figure 13:
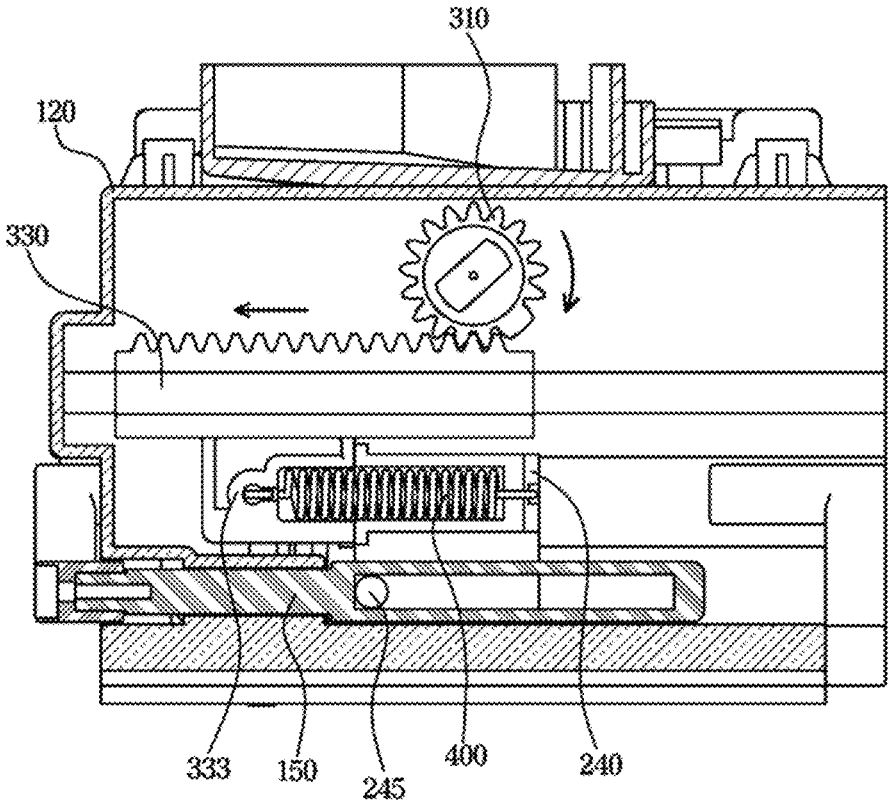
FIG. 13 is a side cross-sectional view illustrating a state before a rack gear is maximally moved in the ice making assembly in the first state of FIG. 10 according to an embodiment of the disclosure.

FIG. 13 is a side cross-sectional view illustrating a state before a rack gear is maximally moved in the ice making assembly in the first state of FIG. 10. FIG. 14 is a side cross-sectional view illustrating a state in which the rack gear is maximally moved in the ice making assembly in the first state of FIG. 10.

An operation of the ice making assembly 1000 in the first state will be described with reference to FIGS. 13 and 14.

As illustrated in FIG. 13, the pinion 310 is rotated clockwise to move the rack gear 330 to one side of the cover frame 120. The rack gear 330 and the second case 240 may be connected by the elastic member 400. The rack gear 330 may be moved in a direction in which the first case 140 and the second case 240 become closer.

As the rack gear 330 and the second case 240 are moved horizontally in the state of FIG. 13, the first tray 170 may come into contact with the second tray 270. The first sealing portion 180 may be formed on the first tray 170 and the second sealing portion 280 may be formed on the second tray 270 to maintain the airtightness between the first tray 170 and the second tray 270. Accordingly, it is possible to prevent leakage at a portion in which the first tray 170 and the second tray 270 come into contact. However, because the first tray 170 and the second tray 270 are formed to have elasticity, a gap may be formed between the first tray 170 and the second tray 270.

Therefore, as illustrated in FIG. 14, the pinion 310 is rotated more clockwise than the state of FIG. 13 to further move the rack gear 330 to one side of the cover frame 120. That is, the rack gear 330 may be in a state of being maximally moved with respect to the cover frame 120 in a direction in which the first case 140 and the second case 240 become closer. In this case, the pinion 310 may be located at the end of the toothed member 331 of the rack gear 330 and may be in a state in which the pinion 310 does not move the rack gear 330 to one side of the cover frame 120 any longer.

The second case 240 is already in the state of being maximally moved in FIG. 13, and thus even when the pinion 310 is further rotated as illustrated in FIG. 14, the second case 240 may be not moved to the first case 140 side. However, as the pinion 310 is rotated, only the rack gear 330 connected to the second case 240 may be further moved to one side of the cover frame 120, and thus the elastic member 400 connecting the rack gear 330 and the second case 240 may be stretched.

Accordingly, when the elastic member 400 is stretched, the second case 240 may be pulled toward the first case 140 by an elastic restoring force. Accordingly, the first tray 170 and the second tray 270 may be in maximum contact, and thus it is possible to more reliably secure the airtightness between the first tray 170 and the second tray 270.

When water is supplied from the water supplier 50 and ice is formed in the above-mentioned state, the first tray 170 and the second tray 270 may come into close contact, and thus the shape of the ice may be clean and no crumb may be generated at the junction.

Figure 15:
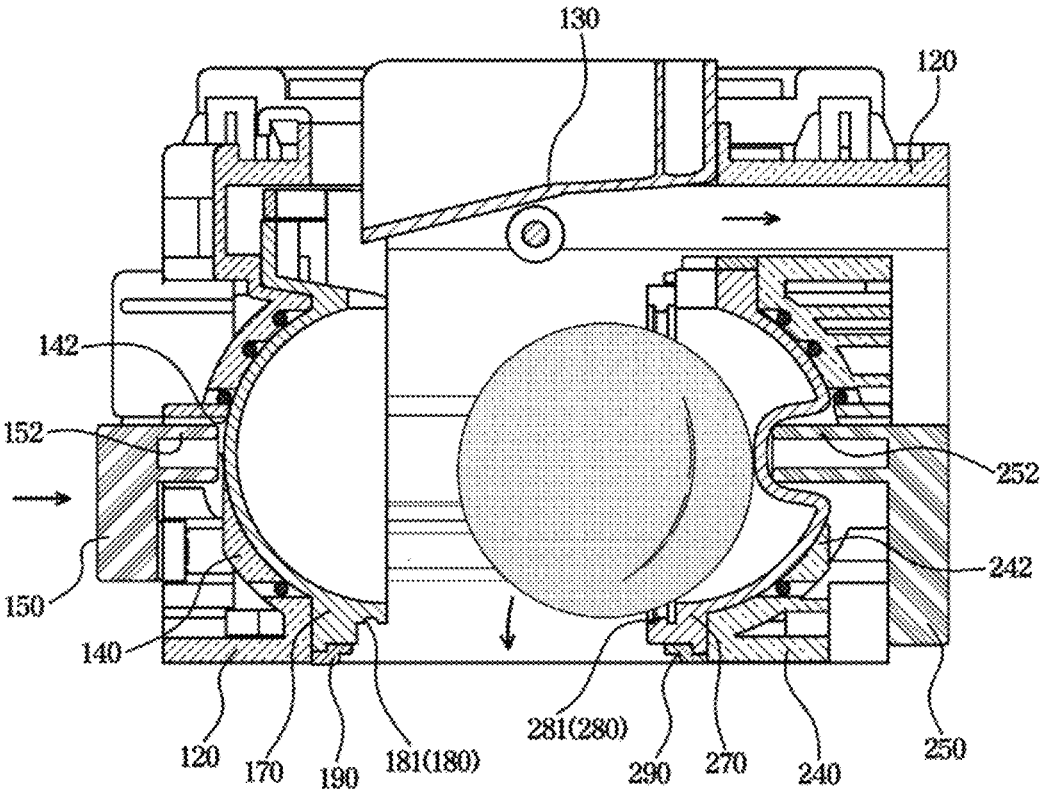
FIG. 15 is a cross-sectional view illustrating a relationship between the first and second ejectors and first and second trays in the ice making assembly in the second state of FIG. 11 according to an embodiment of the disclosure.
Figure 16:
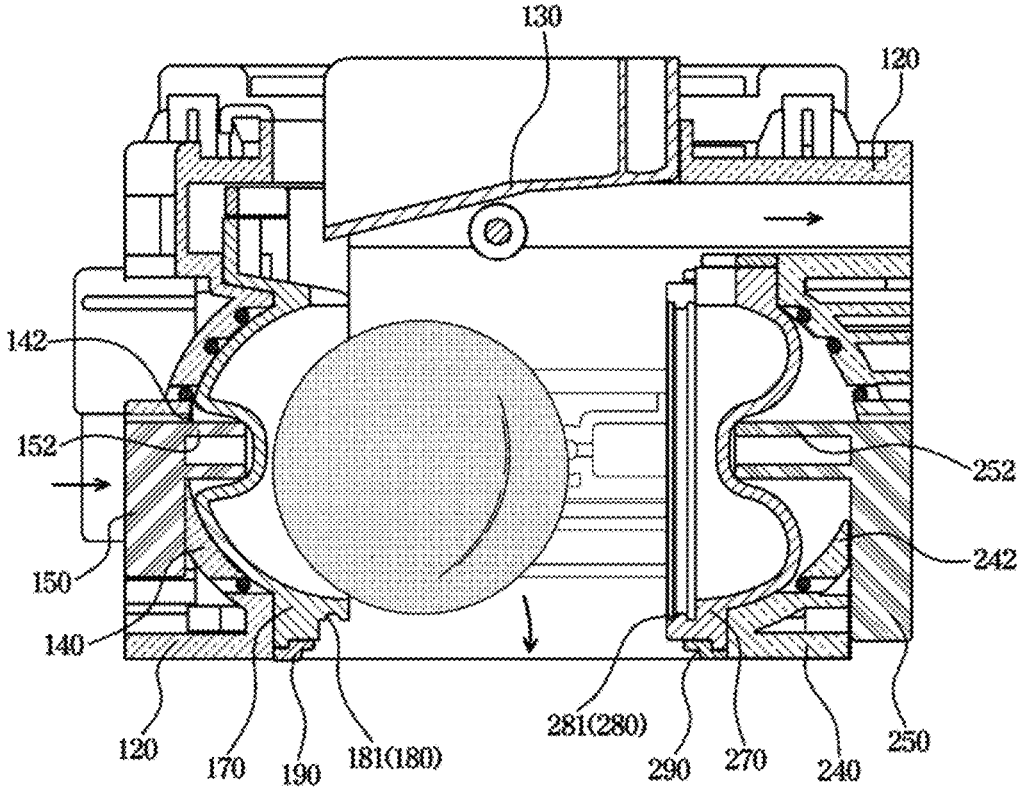
FIG. 16 is a cross-sectional view illustrating the ice making assembly in the third state of FIG. 12 according to an embodiment of the disclosure.

FIG. 15 is a cross-sectional view illustrating a relationship between the first and second ejectors and first and second trays in the ice making assembly in the second state of FIG. 11. FIG. 16 is a cross-sectional view illustrating the ice making assembly in the third state of FIG. 12.

An operation in which the formed ice is separated from the first tray 170 and the second tray 270 will be described with reference to FIGS. 15 and 16.

As illustrated in FIG. 15, when the second case 240 is moved in a direction away from the first case 140 and becomes the second state, the second tray 270 fixed to the second case 240 may be also moved in a direction away from the first tray 170 fixed to the first case 140.

At this time, the ice formed in the tray may be received in the first tray 170 or in the second tray 270.

As the second case 240 and the second tray 270 are moved toward the second ejector 250 in the second state, the second pressing portion 252 of the second ejector 250 may press the second tray 270 by passing through the second through hole 242 of the second case 240.

Because the second tray 270 is formed to have elasticity, the shape of the second tray 270 may be deformed by the pressure of the second ejector 250. When it is assumed that the ice is received in the second tray 270, the ice may be separated from the second tray 270.

As illustrated in FIG. 16, the second case 240 is moved in a direction away from the first case 140 more than in the second state, and becomes the third state.

The third state is a state in which the first ejector 150 is moved. Particularly, the first ejector 150 may be moved toward the first case 140. The first pressing portion 152 of the first ejector 150 may press the first tray 170 by passing through the first through hole 142 of the first case 140.

Because the first tray 170 is formed to have elasticity, the shape of the first tray 170 may be deformed by the pressure of the first ejector 150. When it is assumed that ice is received in the first tray 170, the ice may be separated from the first tray 170.

Accordingly, when the ice making assembly 1000 is in the second state, the second ejector 250 may press the second tray 270, and when the ice making assembly 1000 is in the third state, the first ejector 150 may press the first tray 170. Accordingly, regardless of whether the ice is stored in the first tray 170 or the second tray 270, the ice may be automatically separated from the first tray 170 and the second tray 270.

Figure 17:
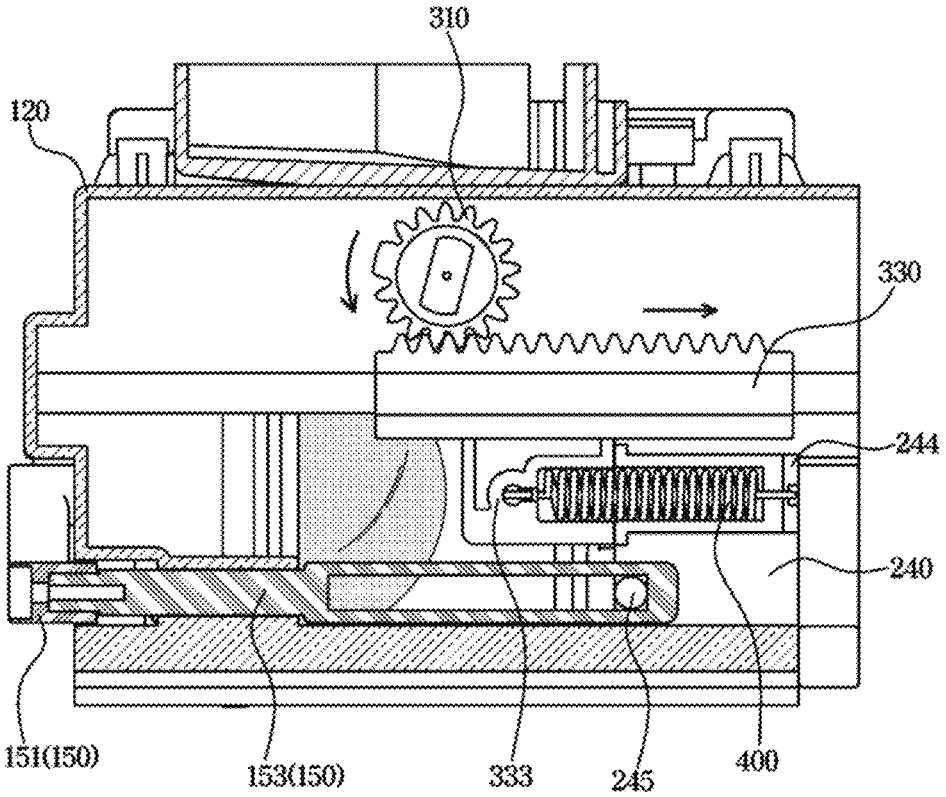
FIG. 17 is a cross-sectional view illustrating a relationship between the first ejector and the second case in the ice making assembly in the second state of FIG. 15 according to an embodiment of the disclosure.
Figure 18:
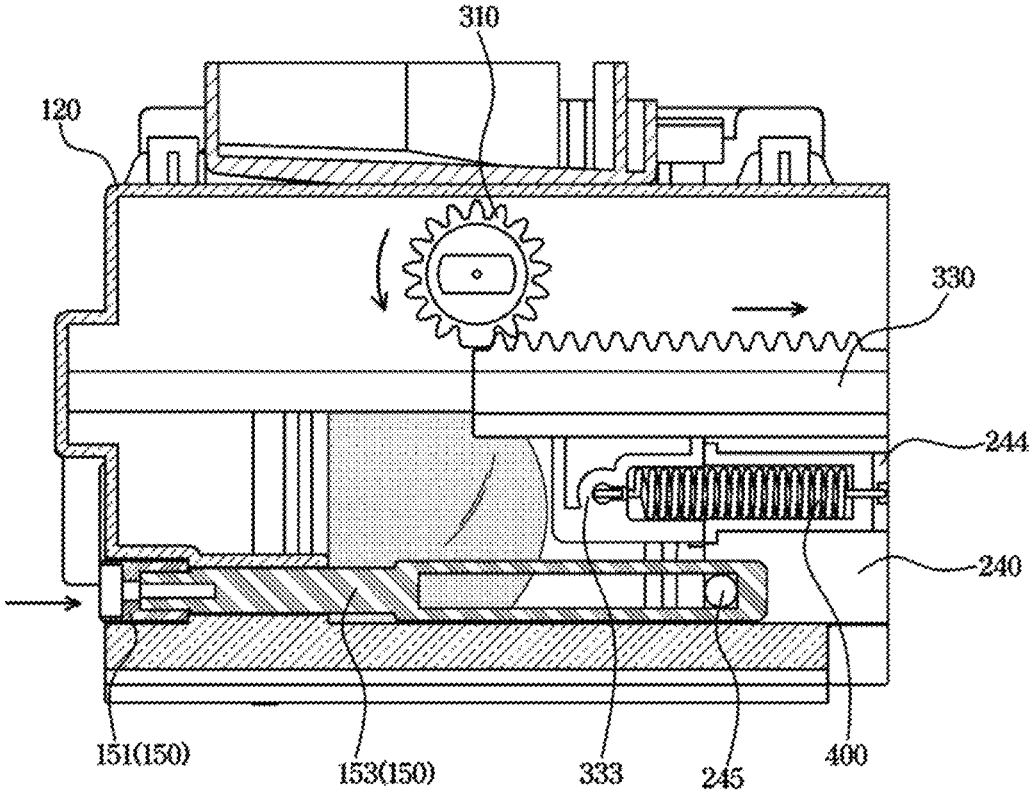
FIG. 18 is a cross-sectional view illustrating a relationship between the first ejector and the second case in the ice making assembly in the third state of FIG. 16 according to an embodiment of the disclosure.

FIG. 17 is a cross-sectional view illustrating a relationship between the first ejector and the second case in the ice making assembly in the second state of FIG. 15. FIG. 18 is a cross-sectional view illustrating a relationship between the first ejector and the second case in the ice making assembly in the third state of FIG. 16.

An operation, in which the first ejector 150 is moved when the ice making assembly 1000 is changed from the second state to the third state as described in FIGS. 15 and 16, will be described with reference to FIGS. 17 and 18.

As illustrated in FIG. 17, when the pinion 310 is rotated counterclockwise and the rack gear 330 is moved to the other side of the cover frame 120, the second case 240 connected to the rack gear 330 may also be moved to the other side of the cover frame 120. The other side of the cover frame 120 is a direction away from the first case 140.

The second case 240 may be connected to the rack gear 330, and may also be connected to the first ejector 150. The protrusion 245 of the second case 240 may be inserted into the protrusion receiving space 154 formed in the leg 153 of the first ejector 150. As the second case 240 is moved, the protrusion 245 may be moved inside the leg 153. When the ice making assembly 1000 becomes the second state, the protrusion 245 of the second case 240 may come into contact with one closed end of the leg 153. However, the second state is a state in which the first ejector 150 is not moved toward the first case 140.

As illustrated in FIG. 18, when the pinion 310 is further rotated counterclockwise and the rack gear 330 is moved further to the other side of the cover frame 120, the second case 240 connected to the rack gear 330 may also be moved further to the other side of the cover frame 120.

As illustrated in FIG. 17, the protrusion 245 is in contact with the closed end of the leg 153 in the second state, and thus when the second case 240 is moved further as illustrated in FIG. 18, the leg 153 of the first ejector 150 may interfere with the protrusion 245 and be moved in the moving direction of the second case 240.

That is, in the third state, the first ejector 150 may be moved toward the first case 140 and press the first tray 170, which is performed in such a way that the protrusion 245 of the second case 240 interferes with the leg 153 of the first ejector 150.

Therefore, when the second case 240 is moved in a direction away from the first case 140, the protrusion 245 and the leg 153 may interfere with each other and thus the first pressing portion 152 of the first ejector 150 may press the first tray 170.

Accordingly, when the formed ice is received in the first tray 170, the formed ice may be automatically separated from the first tray 170.

Figure 19:
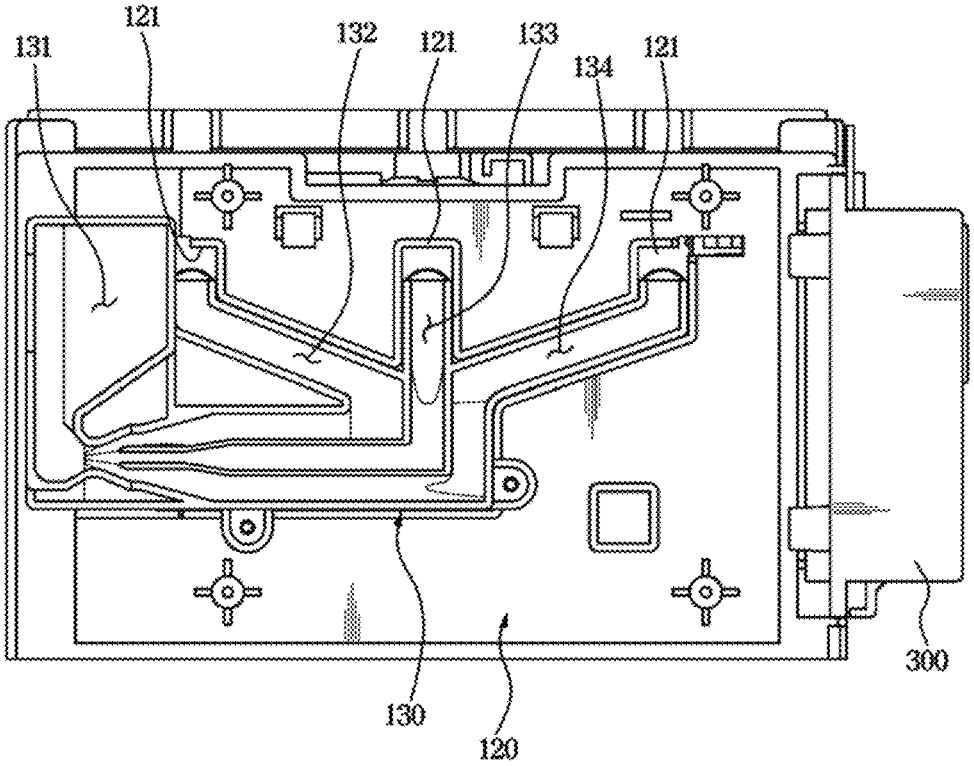
FIG. 19 is a top view illustrating a state in which a water path of the refrigerator according to an embodiment of the disclosure is coupled to the cover frame.
Figure 20:
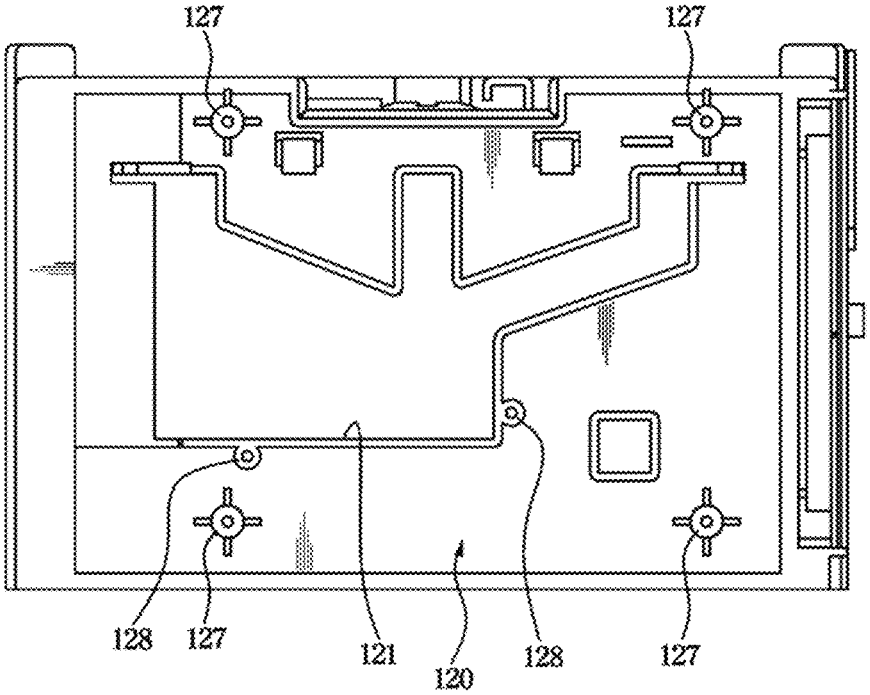
FIG. 20 is a top view illustrating only the cover frame of the refrigerator according to an embodiment of the disclosure.

FIG. 19 is a top view illustrating a state in which a water path of the refrigerator according to one embodiment of the present disclosure is coupled to the cover frame. FIG. 20 is a top view illustrating only the cover frame of the refrigerator according to one embodiment of the present disclosure.

Referring to FIGS. 19 and 20, the water path 130 may be mounted on the upper surface of the cover frame 120. The water path 130 may be provided to allow water, which is supplied from the water supplier 50, to flow into the first tray 170 and the second tray 270 received inside the cover frame 120.

The water path 130 may include a water collector 131 and a plurality of flow paths 132, 133, and 134.

The water collector 131 may be provided to receive water from the water supplier 50 in the refrigerator. The plurality of flow paths may include a first flow path 132, a second flow path 133, and a third flow path 134. The first flow path 132, the second flow path 133, and the third flow path 134 may be branched from the water collector 131. The water collector 131 may be formed to form an inclined surface to allow water, which is supplied from the water supplier 50, to easily flow into the ice-making cell.

The first flow path 132, the second flow path 133, and the third flow path 134 may be provided to evenly supply water to each of the plurality of ice-making cells formed by the first tray 170 and the second tray 270. The first flow path 132, the second flow path 133, and the third flow path 134 may also be provided as inclined surfaces to allow water to flow easily.

The water path 130 may include a coupling member mounting member 135. The coupling member mounting member 135 may be provided to be coupled to a water path coupler 128 of the cover frame 120 to be described later. Accordingly, the water path 130 and the cover frame 120 may be coupled to each other.

The cover frame 120 may include a housing coupler 127 and the water path coupler 128. The water path 130 may be mounted on the cover frame 120 through the water path coupler 128. The cover frame 120 may be mounted to the ice making housing 110 through the housing coupler 127. The cover frame 120 and the ice making housing 110, and the cover frame 120 and the water pass 130 may be coupled as a separate fastening member is fastened to the housing coupler 127 and the water pass coupler 128.

The refrigerator 1 according to one embodiment of the present disclosure may include the plurality of flow paths to evenly supply water to each of the plurality of ice-making cells, thereby dividing water and supplying the water step by step to the plurality of ice-making cells.

Particularly, by controlling the water supplier 50 through a controller, the refrigerator 1 may supply water by dividing the water in stages according to the water level inside the plurality of ice-making cells.

Therefore, when bubbles are generated upon supplying water into the plurality of ice-making cells, it is possible to secure sufficient time for the bubbles to disappear. Accordingly, it may be easy to ensure the transparency of the ice that is finally formed.

Figure 21:
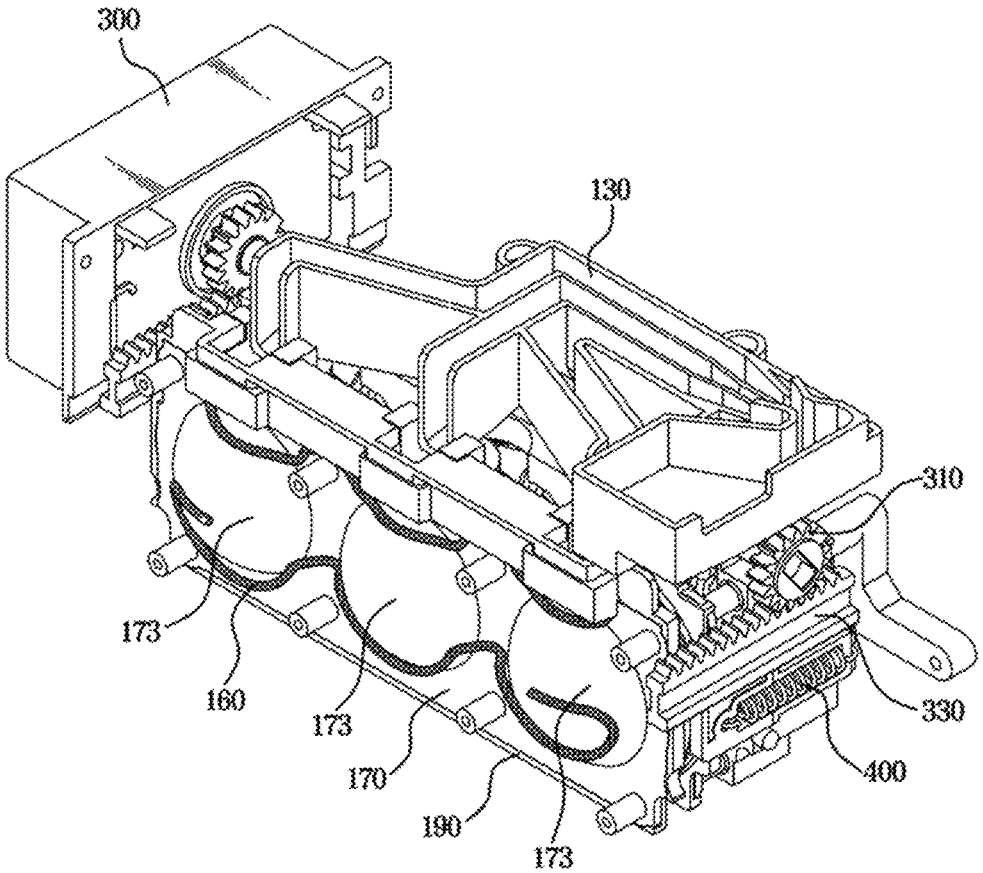
FIG. 21 is a view illustrating a state, in which the first ejector and the cover frame are omitted in the ice making assembly of FIG. 3, when viewed from the first tray side, according to an embodiment of the disclosure.

FIG. 21 is a view illustrating a state, in which the first ejector and the cover frame are omitted in the ice making assembly of FIG. 3, when viewed from the first tray side.

Referring to FIG. 21, the first heating wire 160 may be mounted outside the first tray 170. Particularly, the first heating wire 160 may be mounted between the first tray 170 and the cover frame 120. As described above, the ice making assembly 1000 may include the first heating wire 160 on the first tray 170 side and the second heating wire 260 on the second tray 270 side.

The first heating wire 160 may apply heat to the first tray 170 to allow the ice formed on the first tray 170 to be easily separated from the first tray 170. Although not shown, the second heating wire 260 may play the same role.

As the first heating wire 160 and the second heating wire 260 are provided, the first ejector 150 may be omitted from the ice making assembly 1000. Further, the second ejector 250 may also be omitted from the ice making assembly 1000.

In addition, in the ice making assembly 1000 of the refrigerator 1 according to one embodiment of the present disclosure, the first ice making cell 173 of the first tray 170 and the second ice making cell 273 of the second tray 270 may be formed in approximately the same size and shape. However, the sizes and shapes of the first ice-making cell 173 and the second ice-making cell 273 are not limited thereto.

For example, the size of the first ice-making cell 173 of the first tray 170 may be greater than the size of the second ice-making cell 273 of the second tray 270.

Conversely, the size of the first ice-making cell 173 of the first tray 170 may be less than the size of the second ice-making cell 273 of the second tray 270.

That is, a maximum recess depth of the first ice-making cell 173 of the first tray 170 according to the moving direction of the second ice-making cell 273 may be less than a maximum recess depth of the second ice-making cell 273 of the second tray 270. The recess depth may be defined as a horizontal distance from an open side to a closed side of each ice-making cell 173 or 273 of each tray 170 or 270.

In this case, when the second tray 270 is moved relative to the first tray 170 to separate the ice, the ice may be received in the second ice-making cell 273 of the second tray 270.

In the first ice-making cell 173 and the second ice-making cell 273 provided to make spherical ice, a width of the second ice-making cell 273 along the moving direction may be greater than that of the first ice-making cell 173. Therefore, a portion higher than a lower curvature point of ice may be formed in the second ice-making cell 273. At the same time, a portion lower than an upper curvature point of ice may be formed in the second ice-making cell 273.

Therefore, when the second tray 270 is moved relative to the first tray 170, the ice may interfere with the edge of the second ice-making cell 273, and accordingly, the ice may be moved along the second tray 270 while the ice is received in the second ice-making cell 273.

In addition, the heating wire may be formed only on the side of the first ice-making cell 173 to allow the ice to be more easily separated from the first ice-making cell 173. That is, because the ice making assembly 1000 includes the first heating wire 160 and excludes the second heating wire 260, only the first heating wire 160 may be mounted on the side of the first tray 170.

That is, by forming the widths of the first ice-making cell 173 and the second ice-making cell 273 with respect to the moving direction of the second ice-making cell 173 to be different from each other, the ice making assembly 1000 may be pre-designed to allow ice to be received in one single ice-making cell during the ice removal.

When the ice is formed and the first tray 170 and the second tray 270 are separated in the state in which the first ice-making cell 173 and the second ice-making cell 273 are formed in different sizes, there is a high probability that ice is received in the larger ice-making cell. Accordingly, in this case, it is possible to simplify the structure by providing the ejector to only the relatively larger ice-making cell.

For example, when the size of the first ice-making cell 173 is greater than the size of the second ice-making cell 273, the ice-making assembly 1000 may include the first ejector 150 on the side of the first ice-making cell 173, and exclude the second ejector 250.

Conversely, when the size of the first ice-making cell 173 is less than the size of the second ice-making cell 273, the ice-making assembly 1000 may include only the second ejector 250 on the side of the second ice-making cell 273, and exclude the first ejector 150.

In addition, as a boss shape or an undercut shape is applied only to the inside of one of the first tray 170 and the second tray 270, it is possible to more easily separate the ice from the first tray 170 and the second tray 270. In this case, because the ice is highly likely to be received on the side of the tray to which no shape is applied, it is possible to implement the ice making assembly 1000 including only the ejector adjacent to the tray to which no shape is applied.

In addition, the first ice-making cell 173 of the first tray 170 provided to be fixed to the cover frame 120 may be formed of aluminum, and the second ice-making cell 273 of the second tray 270 provided to be moved relative to the first ice-making cell 173 may be formed of a silicon material. That is, the first ice-making cell 173 and the second ice-making cell 273 have different thermal conductivities, and thus when the second ice-making cell 273 is moved, the ice may be separated from the first ice-making cell 173 and then moved in a state of being received in the second ice-making cell 273.

Accordingly, the ice making assembly 1000 may also be designed to include only the first heating wire 160 and thus ice may be easily separated from the first ice making cell 173 of the first tray 170.

In this case, because the ice is more likely to be moved in a state of being received in the second ice-making cell 273 having lower thermal conductivity than in the first ice-making cell 173 having high thermal conductivity, the ice-making assembly 1000 may be provided in a structure in which only the second ejector 250 is included and the first ejector 150 is excluded.

Figure 22:
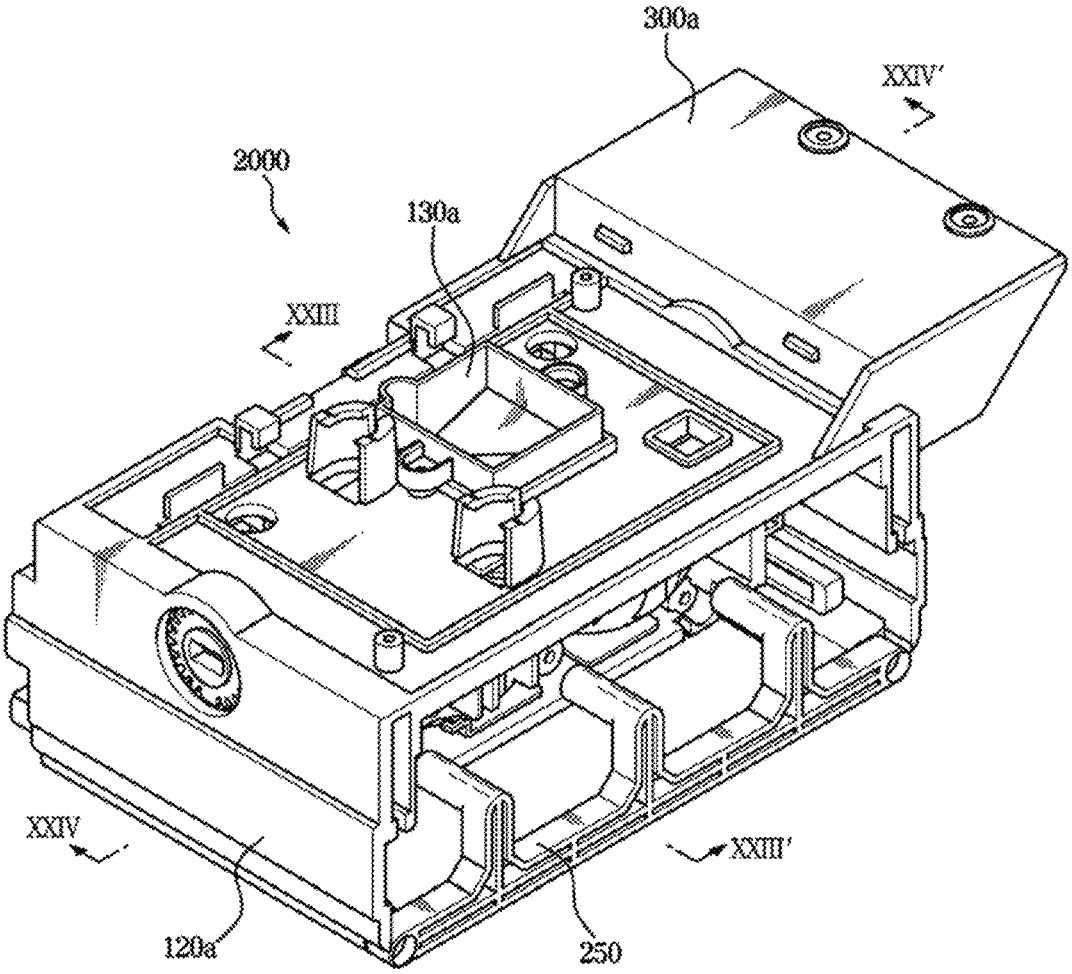
FIG. 22 is a view illustrating an ice making assembly of a refrigerator according to another embodiment of the disclosure.
Figure 23:
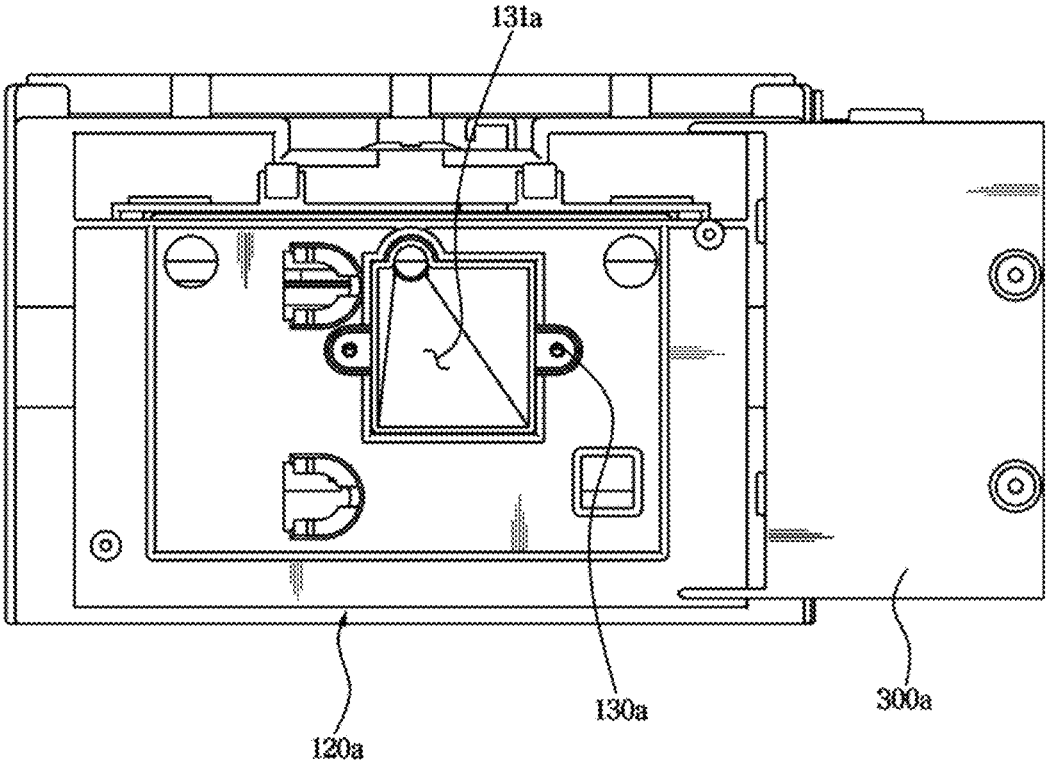
FIG. 23 is a top view of the ice making assembly of FIG. 22 according to an embodiment of the disclosure.

FIG. 22 is a view illustrating an ice making assembly of a refrigerator according to another embodiment of the present disclosure. FIG. 23 is a top view of the ice making assembly of FIG. 22.

As illustrated in FIGS. 22 and 23, an ice making assembly 2000 of a refrigerator according to another embodiment of the present disclosure may include a cover frame 120*a*.

The cover frame 120*a* may be provided to be coupled to the ice-making housing inside the ice-making housing (refer to FIG. 2). The cover frame 120*a* may be provided in a box shape in which one side surface and a lower surface are open. A driver may be mounted on one side surface of the cover frame 120*a*.

In the description of the refrigerator according to another embodiment of the present disclosure, components not separately mentioned may be described using the same names and reference numerals as the components of the refrigerator according to one embodiment of the present disclosure. Hereinafter differences from the refrigerator according to one embodiment of the present disclosure will be mainly described.

The ice making assembly 2000 according to another embodiment of the present disclosure may include a water path 130*a*. The water path 130*a* may be mounted on one surface of the cover frame 120*a*. Particularly, the water path 130*a* may be mounted on an upper surface of the cover frame 120*a*. The water path 130*a* may be provided to allow water, which is supplied from the water supplier, to flow into the cover frame 120*a*. In other words, the water path 130*a* may be provided to allow water, which is supplied from the water supplier, to flow into a first tray 170*a* and a second tray 270*a*.

Unlike the water path 130 of the ice making assembly 1000 according to one embodiment of the present disclosure, the water path 130*a* of the ice making assembly 2000 according to another embodiment of the present disclosure may include a single flow path.

The water path 130*a* may include a water collector 131*a*, and the water collector 131*a* may include a single flow path. The water collector 131*a* may be configured to receive water from the water supplier in the refrigerator. The water collector 131*a* may be formed to form an inclined surface to allow water, which is supplied from the water supplier, to easily flow into the ice-making cell.

The single flow path formed in the water collector 131*a* may be provided to supply water to one ice-making cell among a plurality of ice-making cells formed by the first tray 170*a* and the second tray 270*a*.

An operation, in which water is supplied to a single ice-making cell so as to fill the plurality of ice-making cells with the water, will be described later.

Figure 24:
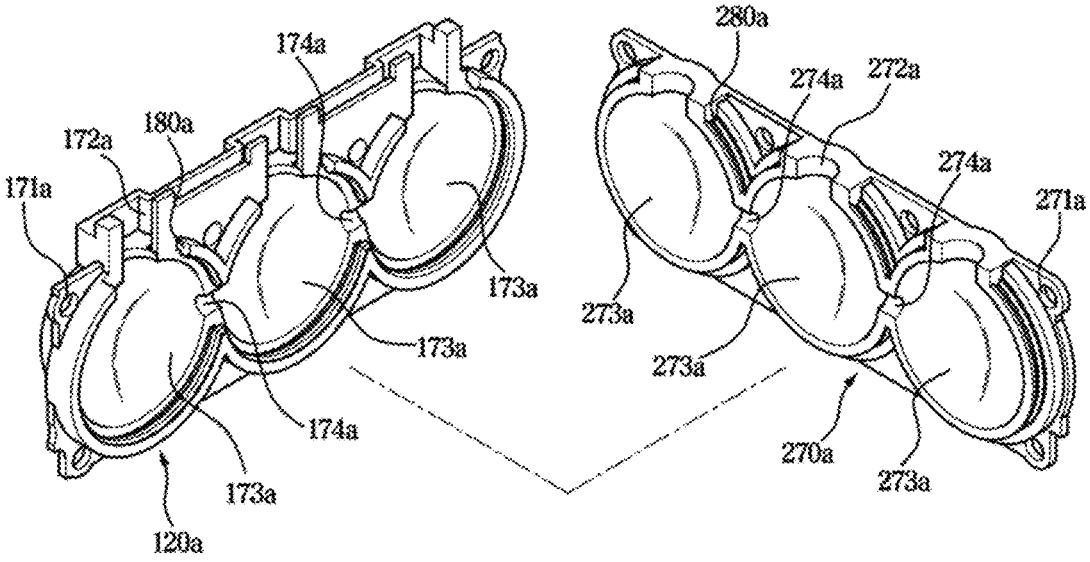
FIG. 24 is a view illustrating a first tray and a second tray of the refrigerator according to another embodiment of the disclosure.
Figure 25:
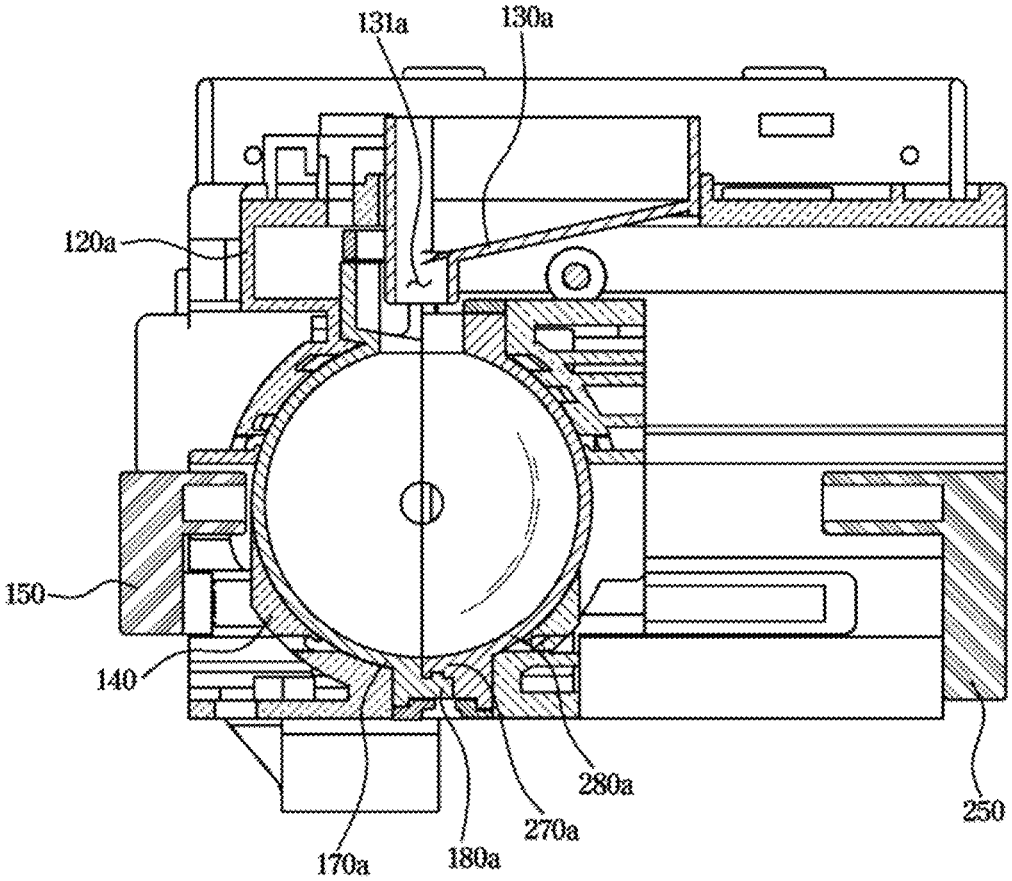
FIG. 25 is a cross-sectional view illustrating a state in which the first tray and the second tray are coupled in the ice making assembly of the refrigerator according to another embodiment of the disclosure.
Figure 26:
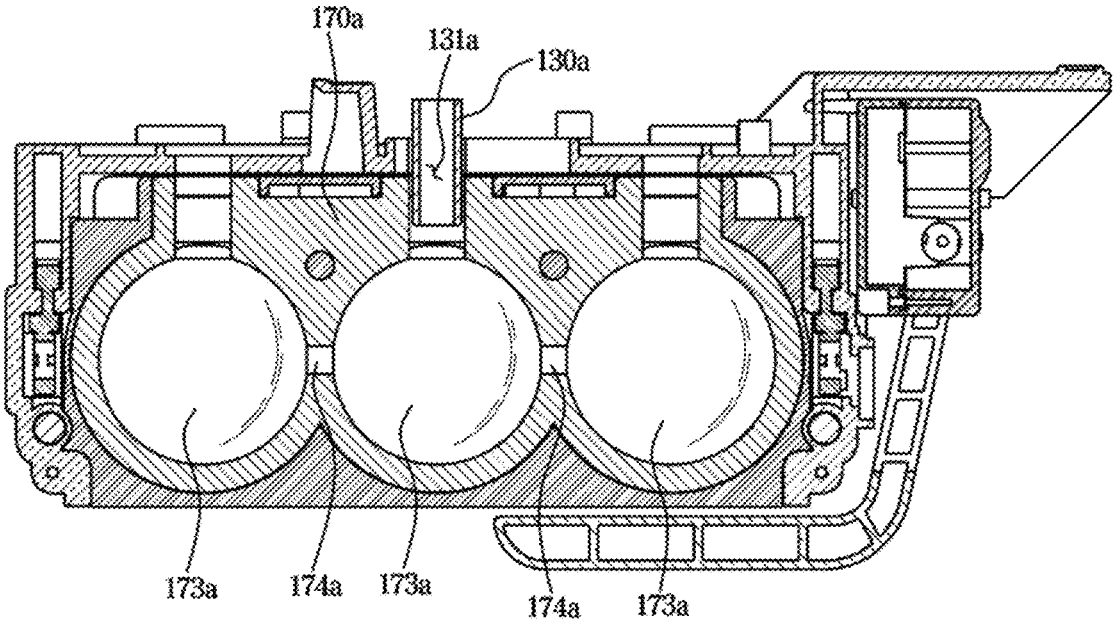
FIG. 26 is a cross-sectional view illustrating a method of supplying water in the ice making assembly of the refrigerator according to another embodiment of the disclosure.

FIG. 24 is a view illustrating a first tray and a second tray of the refrigerator according to another embodiment of the present disclosure. FIG. 25 is a cross-sectional view illustrating a state in which the first tray and the second tray are coupled in the ice making assembly of the refrigerator according to another embodiment of the present disclosure. FIG. 26 is a cross-sectional view illustrating a method of supplying water in the ice making assembly of the refrigerator according to another embodiment of the present disclosure.

As illustrated in FIG. 24, the ice making assembly 2000 of the refrigerator according to another embodiment of the present disclosure may include the first tray 170*a* and the second tray 270*a*.

The first tray 170*a* may include a first guide 172*a*, a first ice-making cell 173*a*, and a first connection flow path 174*a*.

The first guide 172*a* may be formed on an upper side of the first ice-making cell 173*a*. When water overflows from the first ice-making cell 173*a*, the first guide 172*a* may allow the water to flow to the adjacent first ice-making cell 173*a*.

The first tray 170*a* may include a plurality of first ice-making cells 173*a*. The plurality of first ice-making cells 173*a* may be provided to form a portion of ice.

Unlike the first tray 170 of the refrigerator according to one embodiment of the present disclosure, the first tray 170*a* of the refrigerator according to another embodiment of the present disclosure may include the first connection flow path 174*a*.

The first connection flow path 174*a* may be provided to connect adjacent first ice-making cells 173*a* to each other. Particularly, the first connection flow path 174*a* may be formed by being recessed inward from one surface of the first tray 170*a*. The first connection flow path 174*a* may be formed in the center of the first ice-making cell 173*a*. However, the position of the first connection flow path 174*a* is not limited thereto, and it is sufficient that the first connection flow path is provided to connect adjacent first ice-making cells 173*a* to each other.

The second tray 270*a* may include a second guide 272*a*, a second ice-making cell 273*a*, and a second connection flow path 274*a*.

The second guide 272*a* may be formed on an upper side of the second ice-making cell 273*a*. When water overflows from the second ice-making cell 273*a*, the second guide 272*a* may allow water to flow to the adjacent second ice-making cell 273*a*.

The second tray 270*a* may include a plurality of second ice-making cells 273*a*. The plurality of second ice-making cells 273*a* may be provided to form a portion of ice. The first ice-making cell 173*a* and the second ice-making cell 273*a* may be coupled to each other so as to form ice in a perfect shape.

Unlike the second tray 270 of the refrigerator according to one embodiment of the present disclosure, the second tray 270*a* of the refrigerator according to another embodiment of the present disclosure may include the second connection flow path 274*a*.

The second connection flow path 274*a* may be provided to connect adjacent second ice making cells 273*a*.

Particularly, the second connection flow path 274*a* may be formed by being recessed inward from one surface of the second tray 270*a*. The second connection flow path 274*a* may be formed at the center of the second ice-making cell 273*a*. However, the position of the second connection flow path 274*a* is not limited thereto, and it is sufficient that the second connection flow path is provided to connect adjacent second ice-making cells 273*a* to each other.

The second connection flow path 274*a* is formed at a position corresponding to the first connection flow path 174*a* described above, and thus, when the first tray 170*a* and the second tray 270*a* are coupled to each other, the first connection flow path 174*a* and the second connection flow path 274*a* may be provided to form one connection flow path.

The ice making assembly 2000 of the refrigerator according to another embodiment of the present disclosure may include a first sealing portion 180*a* formed on the first tray 170*a*, and a second sealing portion 280*a* formed on the second tray 270*a*. Unlike the refrigerator according to one embodiment of the present disclosure, the first sealing portion 180*a* of the refrigerator according to another embodiment of the present disclosure may include a protrusion, and the second sealing portion 280*a* may include a recess.

However, the positions of the recess and protrusion are not limited thereto. For example, the first sealing portion 180*a* may include the recess and the second sealing portion 280*a* may include the protrusion. That is, it is sufficient that the first sealing portion 180*a* and the second sealing portion 280*a* include overlapping portions to maintain the sealing force.

Referring to FIGS. 25 and 26, water supplied from the water supplier 50 may flow into the first ice-making cell 173*a* and the second ice-making cell 273*a*, which are coupled to each other, through the water collector 131*a*. In this case, the first ice-making cell 173*a* supplied with water may be the central first ice-making cell 173*a* among the plurality of first ice-making cells 173*a*, and the second ice-making cell 273*a* supplied with water may be the central second ice-making cell 273*a* among the plurality of second ice-making cells 273*a*. However, the position of the ice-making cell to which water is supplied is not limited thereto, and water may be supplied to the ice-making cell located at both ends according to the mounting position of the water path 130*a* and the design change of the cover frame 120*a*.

Because the first sealing portion 180*a* and the second sealing portion 280*a* are engaged to maintain a seal between the first tray 170*a* and the second tray 270*a*, the water contained in the first ice-making cell 173*a* and the second ice-making cell 273*a* may not leak.

The flow of water in the following will be described using the first ice-making cell 173*a* as an example, but the second ice-making cell 273*a* may also have the same flow of water.

Water is supplied through the water collector 131*a* of the water path 130*a*, and the supplied water is received in the central first ice-making cell 173*a* among the plurality of first ice-making cells 173*a*. When the first tray 170*a* is filled with water up to the height at which the first connection flow path 174*a* is formed, the water stored in the central first ice-making cell 173*a* flows to the first ice-making cell 173*a* on both sides. That is, water may flow to the first ice-making cell 173*a* on one side through the first connection flow path 174*a* formed on one side of the central first ice-making cell 173*a*, and water may flow to the first ice-making cell 173*a* on the other side through the second connection flow path 274*a* formed on one the other side of the central first ice-making cell 173*a*.

Accordingly, even when a single flow path of the water path 130*a* is formed, the water supplied through the water supplier 50 may be supplied to all of the plurality of ice-making cells to form ice.

Figure 27:
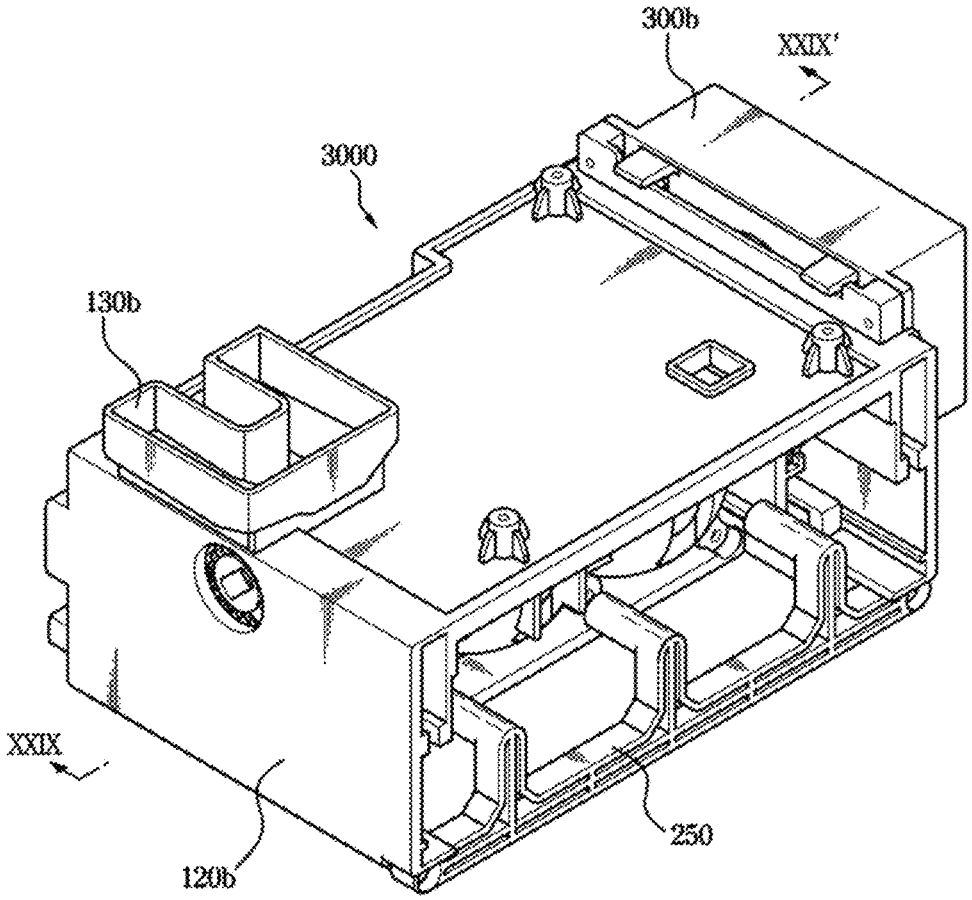
FIG. 27 is a view illustrating an ice making assembly of a refrigerator according to still another embodiment of the disclosure.
Figure 28:
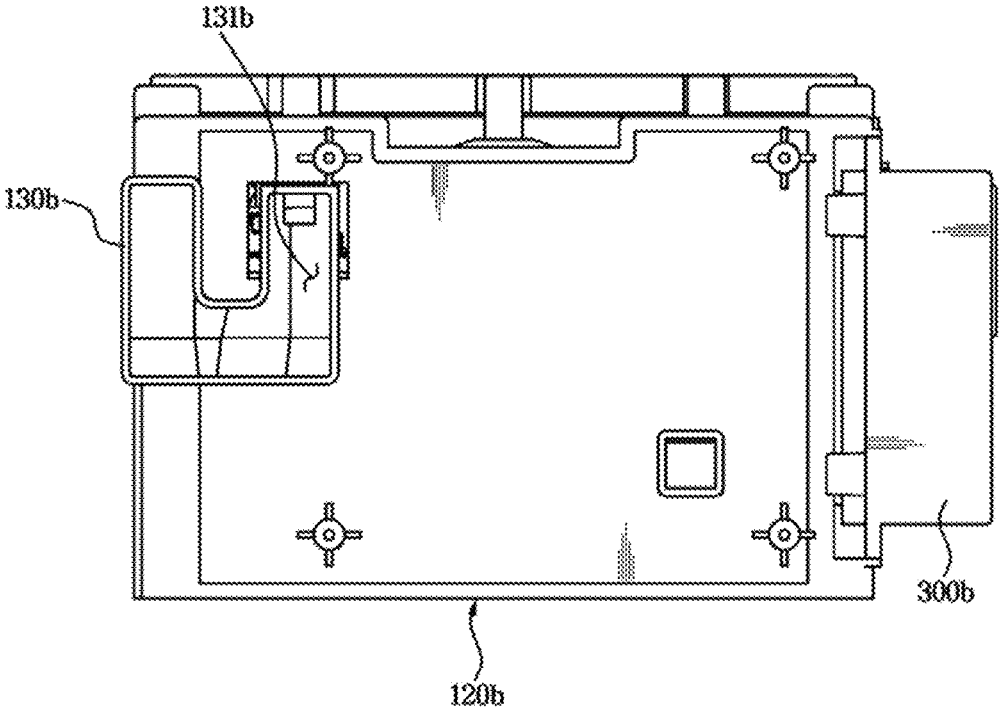
FIG. 28 is a top view of the ice making assembly of FIG. 27 according to an embodiment of the disclosure.

FIG. 27 is a view illustrating an ice making assembly of a refrigerator according to still another embodiment of the present disclosure. FIG. 28 is a top view of the ice making assembly of FIG. 27.

As illustrated in FIGS. 27 and 28, an ice making assembly 3000 of a refrigerator according to still another embodiment of the present disclosure may include a cover frame 120*b*.

The cover frame 120*b* may be coupled to the ice-making housing inside the ice-making housing (refer to FIG. 2). The cover frame 120*b* may be provided in a box shape in which one side surface and a lower surface are open. A driver may be mounted on one side surface of the cover frame 120*b*.

In the description of the refrigerator according to still another embodiment of the present disclosure, components not separately mentioned may be described using the same names and reference numerals as the components of the refrigerator according to one embodiment of the present disclosure. Hereinafter differences from the refrigerator according to one embodiment of the present disclosure will be mainly described.

The ice making assembly 3000 according to still another embodiment of the present disclosure may include a water path 130*b*. The water path 130*b* may be mounted on one surface of the cover frame 120*b*. Particularly, the water path 130*b* may be mounted on an upper surface of the cover frame 120*b*. The water path 130*b* may be provided to allow water, which is supplied from the water supplier 50, to flow into the cover frame 120*b*. In other words, the water path 130*b* may be provided to allow water, which is supplied from the water supplier 50, to flow into a first tray 170*b* and a second tray 270*b*.

Unlike the water path 130 of the ice making assembly 1000 according to one embodiment of the present disclosure, the water path 130*b* of the ice making assembly 3000 according to still another embodiment of the present disclosure may include a single flow path.

The water path 130*b* may include a water collector 131*b*, and the water collector 131*b* may include a single flow path. The water collector 131*b* may be configured to receive water from the water supplier 50 in the refrigerator. The water collector 131*b* may be formed to form an inclined surface to allow water, which is supplied from the water supplier 50, to easily flow into the ice-making cell.

The single flow path formed in the water collector 131*b* may be provided to supply water to one ice-making cell among a plurality of ice-making cells formed by the first tray 170*b* and the second tray 270*b*. This is the same as the water path 130, 130*a* of the refrigerator according to another embodiment of the present disclosure.

However, an operation, in which water is supplied to a single ice-making cell so as to fill the plurality of ice-making cells with the water, may be different from the water path 130*a* of the refrigerator according to another embodiment of the present disclosure, and a description thereof will be described later.

Figure 29:
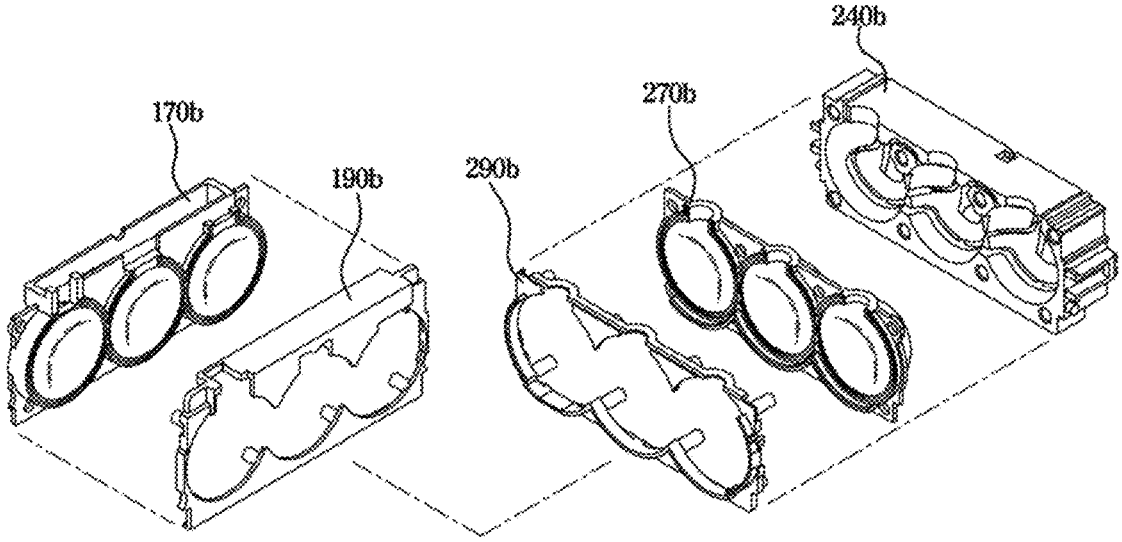
FIG. 29 is a view illustrating a first tray, a first fixing frame, a second fixing frame, a second tray, and a second case of the refrigerator according to still another embodiment of the disclosure.
Figure 30:
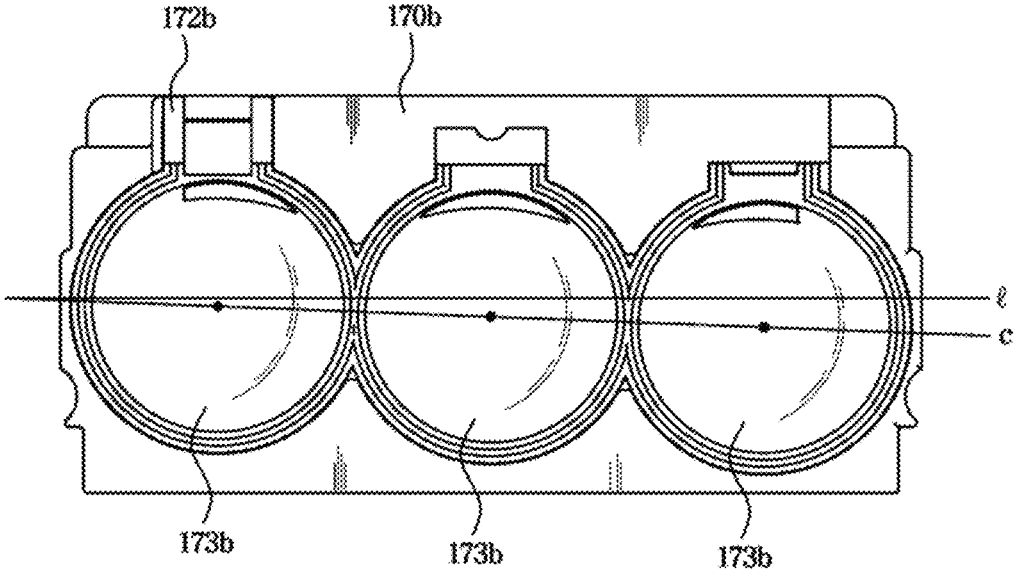
FIG. 30 is a front view of the first tray of the refrigerator according to still another embodiment of the disclosure.
Figure 31:
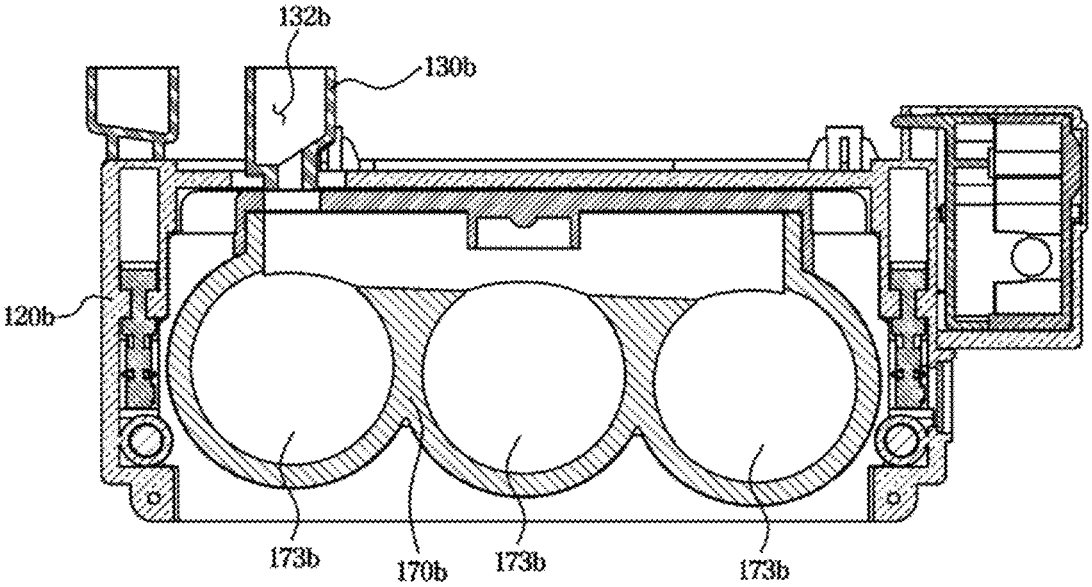
FIG. 31 is a cross-sectional view illustrating a method of supplying water in the ice making assembly of the refrigerator according to still another embodiment of the disclosure.

FIG. 29 is a view illustrating a first tray, a first fixing frame, a second fixing frame, a second tray, and a second case of the refrigerator according to still another embodiment of the present disclosure. FIG. 30 is a front view of the first tray of the refrigerator according to still another embodiment of the present disclosure. FIG. 31 is a cross-sectional view illustrating a method of supplying water in the ice making assembly of the refrigerator according to still another embodiment of the present disclosure.

As illustrated in FIG. 29, the ice making assembly 3000 of the refrigerator according to still another embodiment of the present disclosure may include the first tray 170*b*, a first fixing frame 190*b*, the second tray 270*b*, a second fixing frame 290*b*, and a second case 240*b*.

The first tray 170*b* may include a first guide 172*b* and a first ice-making cell 173*b*.

The first guide 172*b* may be formed on an upper side of the first ice-making cell 173*b*. When water overflows from the first ice-making cell 173*b*, the first guide 172*b* may allow the water to flow to the adjacent first ice-making cell 173*b*.

The first tray 170*b* may include a plurality of first ice-making cells 173*b*. The plurality of first ice-making cells 173*b* may be provided to form a portion of ice.

Unlike the first tray 170*a* of the refrigerator according to another embodiment of the present disclosure, the first tray 170*b* of the refrigerator according to still another embodiment of the present disclosure may not include the first connection flow path 174*a*.

Referring to FIGS. 29 and 30, the first trays 170*b* of the refrigerator according to still another embodiment of the present disclosure may be formed at different heights. In other words, each of the plurality of first ice-making cells 173*b* may be provided to have a height difference.

Particularly, a line C connecting centers of each of the first ice-making cells 173*b* of the first tray 170*b* of the refrigerator according to still another embodiment of the present disclosure may have a predetermined angle with respect to a horizontal line L.

As each of the plurality of first ice-making cells 173*b* has a height difference, openings of the first fixing frame 190*b* provided to support and fix the plurality of first ice-making cells 173*b* may also have a height difference.

The second tray 270*b* may include a plurality of second ice making cells 273.

The plurality of second ice-making cells 273 may be provided to form a portion of ice. The first ice-making cell 173*b* and the second ice-making cell 273 may be coupled to each other to form ice in a perfect shape.

Unlike the second tray 270*a* of the refrigerator according to another embodiment of the present disclosure, the second tray 270*b* of the refrigerator according to still another embodiment of the present disclosure may not include the second connection flow path 274*a*.

Because the second tray 270*b* of the refrigerator according to still another embodiment of the present disclosure corresponds to the first tray 170*b*, the second tray 270*b* may be formed at different heights in the same manner as the above-described first tray 170*b*. In other words, each of the plurality of second ice making cells 273 may be provided to have a height difference.

As each of the plurality of second ice-making cells 273 has a height difference, openings of the second fixing frame 290*b* provided to support and fix the plurality of second ice-making cells 273 may also have a height difference. In addition, a receiving member of the second tray 270*b* of the second case 240*b* provided to receive the second tray 270*b* may also have a height difference.

Referring to FIG. 31, water supplied from the water supplier 50 may flow into the first ice-making cell 173*b* and the second ice-making cell 273 through the water collector 131*b* of the water path 130*b*.

At this time, the first ice-making cell 173*b*, to which water is supplied, may be the first ice-making cell 173*b*, which is farthest from the driver, among the plurality of first ice-making cells 173*b*, and the second ice-making cell 273, to which water is supplied, may be the second ice-making cell 273, which is farthest from the driver, among the plurality of second ice-making cells 273. However, the location of the ice-making cell, to which water is supplied, is not limited thereto, and water may be supplied to the ice-making cell at another location according to the mounting position of the water path 130*b* and design change of the cover frame 120*b*.

The flow of water in the following will be described using the first ice-making cell 173*b* as an example, but the second ice-making cell 273 may also have the same flow of water.

Water is supplied through the water collector 131*b* of the water path 130*b*, and the supplied water is received in one of the plurality of first ice-making cells 173*b*. When the first ice-making cell 173*b* of the first tray 170*b* is almost filled with water, the water stored in the first ice-making cell 173*b* flows to the adjacent first ice-making cell 173*b*. The water may flow through the first guide 172*b* of the first tray 170*b*. Thereafter, when the first ice-making cell 173*b*, which is supplied with water from the water supplier 50, and the first ice-making cell 173*b* adjacent to the first ice-making cell 173*b* are almost filled with water, water flows into the adjacent first ice-making cell 173*b*. An ice-making cell, to which water is finally supplied, may be the first ice-making cell 173*b* closest to the driver. That is, the plurality of ice-making cells is sequentially filled with water according to the arrangement position.

Accordingly, even when the flow path of the water path 130*b* is formed as a single unit, the water supplied through the water supplier may be supplied to all of the plurality of ice-making cells to form ice.

Embodiments of the disclosure may provide a refrigerator including a storage compartment, and an ice making assembly mounted to one side of the storage compartment. The ice making assembly includes a cover frame, a first tray fixed to the cover frame to form a first portion of ice, a second tray engaged with the first tray so as to form a second portion of the ice, the second tray configured to be moved horizontally with respect to the first tray, and a water path mounted on the cover frame and provided to equally supply water to each of a plurality of ice-making cells formed by the first tray and the second tray. The refrigerator may further include a first sealing portion recessed along an edge of the ice-making cell of the first tray and a second sealing portion formed along an edge of the ice-making cell of the second tray, the second sealing portion provided to protrude to overlap the first tray so as to prevent leakage. The refrigerator may control a water supplier to divide and supply water to the plurality of ice-making cells according to a water level of the plurality of ice-making cells.

Embodiments of the disclosure may provide a refrigerator including a storage compartment, an ice-making housing mounted on the storage compartment, a cover frame coupled to an inside of the ice-making housing, a first case fixed to the cover frame to receive a first tray provided to form a first portion of ice, a second case provided to receive a second tray provided to form a second portion of the ice, the second case configured to be moved with respect to the cover frame, a driver coupled to the cover frame to generate power, a pinion configured to be rotated according to the drive of the driver, and a rack gear configured to be moved by being engaged with the pinion, and coupled to the second case to allow the second tray and the second case to be linearly moved relative to the cover frame. The rack gear and the second case may be connected by an elastic member.

While the present disclosure has been particularly described with reference to exemplary embodiments, it should be understood by those of skilled in the art that various changes in form and details may be made without departing from the spirit and scope of the present disclosure.

What is claimed is:

1. A refrigerator, comprising:

a storage compartment;

a water supplier to supply water received from an external water supply source;

an ice-making housing in the storage compartment;

a first tray disposed in the ice-making housing and including:

a plurality of first ice-making cells, and a first sealing portion formed along an edge of each first ice-making cell of the plurality of first ice-making cells; and a second tray including:

a plurality of second ice-making cells, and a second sealing portion formed along an edge of each second ice-making cell of the plurality of second ice-making cells, wherein the first tray and the second tray are configured so that:

the second tray is movable horizontally with respect to the first tray to engage with the first tray and couple the plurality of first ice-making cells to the plurality of second ice-making cells, and while the second tray is engaged with the first tray, the second sealing portion of each second ice-making cell of the plurality of second ice-making cells overlaps a respective first sealing portion of each first ice-making cell of the plurality of first ice-making cells to prevent leakage from the plurality of first ice-making cells and the plurality of second ice-making cells, each first ice-making cell of the plurality of first ice-making cells forms a first portion of ice with water supplied from the water supplier, and each second ice-making cell of the plurality of second ice-making cells forms a second portion of the ice with the water supplied from the water supplier.

2. The refrigerator of claim 1, wherein the first sealing portion includes:

a recess recessed inward from an outer circumferential surface of the first tray, and the second sealing portion includes:

a protrusion extending outward from an inner circumferential surface of the second tray and configured to be mountable on the recess to maintain a seal between the first tray and the second tray.

3. The refrigerator of claim 1, further comprising:

a cover frame coupled to the ice-making housing;

a first case formed on one surface of the cover frame to receive the first tray; and a second case configured to be moved inside the cover frame, and to receive the second tray.

4. The refrigerator of claim 3, further comprising:

a rack gear connected to the second case and configured to be moved relative to the cover frame, wherein the second case is moved horizontally with respect to the cover frame in conjunction with a movement of the rack gear.

5. The refrigerator of claim 4, further comprising:

a driver configured to generate power; and a pinion configured to be rotated according to a drive of the driver;

wherein the pinion and the rack gear are engaged to convert a rotational motion of the driver into a linear motion.

6. The refrigerator of claim 4, further comprising:

an elastic member to connect the rack gear to the second case, wherein in response to the rack gear being maximally moved in a direction in which the second case moves toward the first case, the elastic member is tensioned and airtightness between the second case and the first case is maintained by an elastic restoring force.

7. The refrigerator of claim 3, further comprising:

a first ejector including a pressing portion, wherein the first case includes a plurality of through holes corresponding to positions of the plurality of first ice-making cells, and the pressing portion is configured to pass through the plurality of through holes so as to press the first tray.

8. The refrigerator of claim 7, wherein the first ejector includes:

a body configured to support the pressing portion, and a leg extending from each of opposite ends of the body and inserted into respective side portions of the cover frame, the second case includes:

a protrusion extending from each of opposite ends of the second case to be respectively received in the legs, and in response to the second case being moved in a direction away from the first case, the protrusions interfere with the legs, and the first ejector is moved in a direction closer to the first case such that the pressing portion presses the first tray.

9. The refrigerator of claim 7, further comprising:

a second ejector fixed to one side of the cover frame and including a pressing portion extending toward the second case, wherein in response to the second case being moved in a direction away from the first case, the pressing portion of the second ejector passes through the second case so as to press the second tray.

10. The refrigerator of claim 1, wherein each first ice-making cell of the plurality of first ice-making cells of the first tray and each second ice-making cell of the plurality of second ice-making cells of the second tray are configured in a semi-spherical shape.

11. The refrigerator of claim 1, further comprising:

a cover frame coupled to an inside of the ice-making housing; and a water path configured on an upper surface of the cover frame to guide the water supplied from the water supplier to flow into the first tray and the second tray.

12. The refrigerator of claim 11, wherein the water path includes a plurality of flow paths to equally supply water to each first ice-making cell of the plurality of first ice-making cells of the first tray and each second ice-making cell of the plurality of second ice-making cells of the second tray.

13. The refrigerator of claim 12, wherein the refrigerator further comprises a controller configured to control the water supplier to supply the water.

14. The refrigerator of claim 11, wherein the second sealing portion of each second ice-making cell of the plurality of second ice-making cells overlaps a respective first sealing portion of each first ice-making cell of the plurality of first ice-making cells to respectively form a plurality of sealed ice-making cells, the water path includes a single flow path to guide the water to only one sealed ice-making cell among the plurality of sealed ice-making cells, and each sealed ice-making cell of the plurality of sealed ice-making cells is configured at a different height so that the water overflows the one sealed ice-making cell among the plurality of sealed ice-making cells to sequentially fill remaining sealed ice-making cells among the plurality of sealed ice-making cells with the water.

15. The refrigerator of claim 11, wherein the second sealing portion of each second ice-making cell of the plurality of second ice-making cells overlaps a respective first sealing portion of each first ice-making cell of the plurality of first ice-making cells to respectively form a plurality of sealed ice-making cells, the water path includes a single flow path to guide the water to only one sealed ice-making cell among the plurality of sealed ice-making cells, and the first tray and the second tray include a connection flow path provided to allow the water, which is supplied to the one sealed ice-making cell, to flow to an adjacent sealed ice-making cell among the plurality of sealed ice-making cells.

* * * * *